US009211701B2

(12) United States Patent
Kusuhata

(10) Patent No.: US 9,211,701 B2
(45) Date of Patent: Dec. 15, 2015

(54) INK JET PRINTER

(71) Applicant: RISO KAGAKU CORPORATION, Tokyo (JP)

(72) Inventor: Masahiko Kusuhata, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 128 days.

(21) Appl. No.: 13/803,786

(22) Filed: Mar. 14, 2013

(65) Prior Publication Data

US 2013/0257951 A1 Oct. 3, 2013

(30) Foreign Application Priority Data

Mar. 30, 2012 (JP) ..... 2012-079432

(51) Int. Cl.
*B41J 2/045* (2006.01)

(52) U.S. Cl.
CPC ..... *B41J 2/04528* (2013.01); *B41J 2/04563* (2013.01); *B41J 2/04581* (2013.01); *B41J 2202/12* (2013.01); *B41J 2202/20* (2013.01)

(58) Field of Classification Search
USPC ..... 347/11–15
See application file for complete search history.

(56) References Cited

U.S. PATENT DOCUMENTS

| | | | | |
|---|---|---|---|---|
| 5,289,210 | A * | 2/1994 | Takayanagi | 347/14 |
| 8,256,860 | B2 * | 9/2012 | Nakamura | 347/14 |
| 8,419,150 | B2 * | 4/2013 | Bansyo | 347/14 |
| 8,777,355 | B2 * | 7/2014 | Kagata et al. | 347/14 |
| 2010/0085395 | A1 * | 4/2010 | Shimoda et al. | 347/6 |
| 2010/0315451 | A1 * | 12/2010 | Bansyo et al. | 347/6 |
| 2010/0328389 | A1 * | 12/2010 | Kunimine et al. | 347/14 |

FOREIGN PATENT DOCUMENTS

JP 2004-322508 11/2004

* cited by examiner

*Primary Examiner* — Matthew Luu
*Assistant Examiner* — Lily Kemathe
(74) *Attorney, Agent, or Firm* — Hamre, Schumann, Mueller & Larson, P.C.

(57) ABSTRACT

An ink jet printer includes an image control unit that controls rotation of image data so that a direction of a short side of a rectangular area in a printing sheet becomes a print width direction that is orthogonal to a sheet transport direction if a first warm-up time calculated by a warm-up time calculation unit is shorter than a warm-up time until an ink temperature of an overall ink discharge target width of an ink jet head reaches an appropriate temperature range.

3 Claims, 19 Drawing Sheets

FIG.8

| INK TEMPERATURE IN PREDETERMINED HEAD BLOCK 3 | PRINTABLE WIDTH |
|---|---|
| EQUAL TO OR HIGHER THAN Ta | PRINTABLE WITH 330 mm |
| EQUAL TO OR HIGHER THAN Tb | PRINTABLE WITH 220 mm |
| EQUAL TO OR HIGHER THAN Tc | PRINTABLE WITH 110 mm |

FIG.10

| INK TEMPERATURE | WARM-UP TIME |
| --- | --- |
| 0℃ | X1 SECOND |
| 5~10℃ | X2 SECONDS |
| ⋮ | ⋮ |

NON-ROTATION

INK JET PRINTER

BACKGROUND OF THE INVENTION

1. Field of the Invention

The present invention relates to an ink jet printer which hastens completion of the execution of a print job in the situation where a difference in ink temperature occurs depending on a position in a line type ink jet head and, further, in the case where the ink temperature of the ink jet head is out of an appropriate temperature range during execution of the print job.

2. Description of the Related Art

In general, the viscosity of ink that is used in an ink jet type printer is increased under a low temperature environment and is decreased under a high temperature environment. As a result, if the ink temperature is too high or too low, it becomes difficult for an ink jet head to discharge an appropriate amount of ink. Due to this, in the ink jet type printer, an appropriate temperature range when ink is used is determined so that an appropriate discharge operation can be performed.

Further, in the case where the overall width of a head is long and the head includes a plurality of head blocks, like a line type ink jet head, there is a problem that a difference in ink temperature occurs between the head blocks depending on the installation positions of the head blocks. That is, under a low temperature environment, since a head block that is installed near the center is surrounded by other head blocks, the ink temperature becomes relatively higher. By contrast, in a head block that is installed in an end portion, the amount of heat which is lost by the surroundings becomes larger, and thus the ink temperature becomes lowered. The tendency of the ink temperature of such an ink jet head appears noticeably under the low temperature environment.

In order to solve this problem, according to a technique described in JP-2004-322508A, the following control is performed so as to maintain a line type ink jet head that includes a plurality of head blocks at a predetermined temperature and to make the temperature of ink in all head blocks reach an appropriate temperature range.

That is, head blocks located near the end are assumed as one set, head blocks located in the center portion are assumed as one set, and temperature control using the same temperature sensing unit is performed with respect to the head blocks in the respective sets.

SUMMARY OF THE INVENTION

However, the above-described technique in the related art has the following problem under the low temperature environment. That is, in the related art as described above, even if printing to a printing sheet is possible with a width that is shorter than the overall width of the line-type ink jet head, it is considered that the printing starts after the ink temperature of the overall width reaches the appropriate temperature range.

Due to this, it takes time to warm up the ink to the appropriate temperature range in which the printing can start. Accordingly, the starting of the execution of the print job becomes slow, and thus the completion of the execution of the print job also becomes slow.

The invention has been made in view of the above problems, and an object of the invention is to provide an ink jet printer, which hastens completion of the execution of a print job in the situation where a difference in ink temperature occurs depending on a position in a line type ink jet head and, further, in the case where the ink temperature of the line type ink jet head is out of an appropriate temperature range during execution of the print job.

According to a first aspect of the present invention, an ink jet printer performing execution of a print job using a line type ink jet head which acquires the print job that includes image data for forming an image in a rectangular area on a recording medium and performs the image forming through an ink discharge in a print width direction that is orthogonal to a transport direction of the recording medium, is provided. The ink jet printer includes a temperature adjustment means for performing a warm-up operation to make an ink temperature in the line type ink jet head reach an appropriate temperature range; an appropriate temperature range determination means for determining whether or not the ink temperature in the line type ink jet head is in the appropriate temperature range in a first ink discharge target width where an ink discharge is possible in a short side of the rectangular area in an acquisition timing of the print job; a warm-up time calculation means for calculating a first warm-up time by using the temperature adjustment means until the ink temperature in the line type ink jet head corresponding to the first ink discharge target width, which is determined to be out of the appropriate temperature range by the appropriate temperature range determination means, reaches the appropriate temperature range; and an image control means for controlling rotation of the image data so that a direction of the short side of the rectangular area becomes the print width direction if the first warm-up time calculated by the warm-up time calculation means is shorter than a warm-up time until the ink temperature of the overall ink discharge target width of the line type ink jet head reaches the appropriate temperature range.

According to a second aspect of the present invention, the appropriate temperature range determination means determines whether or not the ink temperature in the line type ink jet head is in the appropriate temperature range in a second ink discharge target width where the ink discharge is permitted in a length of a long side of the rectangular area in the acquisition timing of the print job; the warm-up time calculation means calculates a second warm-up time until the ink temperature in the line type ink jet head corresponding to the second ink discharge target width, which is determined to be out of the appropriate temperature range by the appropriate temperature range determination means, reaches the appropriate temperature range using the temperature adjustment means; a job execution time measurement means is provided for measuring a first execution time until the execution of the print job, which has started using the line type ink jet head in the first ink discharge target width, is completed and a second execution time until the execution of the print job, which has started using the line type ink jet head in a second ink discharge target width, is completed for every number of recording media used for the execution of the print job; and the image control means controls the rotation of the image data so that the direction of the short side of the rectangular area or the direction of the long side of the rectangular area becomes the print width direction depending on the number of recording media used for the execution of the print job based on a result of a comparison of a sum of the first execution time and the first warm-up time with a sum of the second execution time and the second warm-up time.

According to a third aspect of the present invention, if the number of recording media is equal to or smaller than a predetermined number, the image control means controls the rotation of the image data so that the direction of the short side of the rectangular area becomes the print width direction, and if the number of recording media is larger than the predetermined number, the image control means controls the rotation of the image data so that the direction of the long side of the rectangular area becomes the print width direction.

According to a fourth aspect of the present invention, if the number of recording media is equal to or larger than a predetermined number, the image control means controls the rotation of the image data so that the direction of the short side of the rectangular area becomes the print width direction, and if it is determined that the ink temperature in the line type ink jet head corresponding to the second ink discharge target width is in the appropriate temperature range by the appropriate temperature range determination means, the image control means controls the rotation of the image data so that the direction of the long side of the rectangular area becomes the print width direction.

According to a fifth aspect of the present invention, an ink jet printer performing execution of a print job using a line type ink jet head which acquires the print job that includes image data for forming an image in a rectangular area on a recording medium and performs the image forming through an ink discharge in a print width direction that is orthogonal to a transport direction of the recording medium, is provided. The ink jet printer includes a temperature adjustment means for performing a warm-up operation to make an ink temperature in the line type ink jet head reach an appropriate temperature range; an appropriate temperature range determination means for determining whether or not the ink temperature in the line type ink jet head is in the appropriate temperature range in a ink discharge target width where an ink discharge is possible in a length of a long side of the rectangular area in an acquisition timing of the print job; a warm-up time calculation means for calculating a warm-up time by using the temperature adjustment means until the ink temperature in the line type ink jet head corresponding to the ink discharge target width, which is determined to be out of the appropriate temperature range by the appropriate temperature range determination means, reaches the appropriate temperature range; and an image control means for controlling rotation of the image data so that a direction of the long side of the rectangular area becomes the print width direction if the warm-up time calculated by the warm-up time calculation means is shorter than a warm-up time until the ink temperature of the overall ink discharge target width of the line type ink jet head reaches the appropriate temperature range.

According to the first aspect or the fifth aspect of the present invention, the rotation of the image data is controlled so that the direction of the short side or the long side of the rectangular area becomes the print width direction and the image forming becomes possible through the line type ink jet head in the ink discharge target width which is calculated to be the warm-up time that is shorter than the warm-up time until the ink temperature of the overall ink discharge target width of the line type ink jet head reaches the appropriate temperature range.

Through this, the situation that the execution of the print job is unable to start until the ink temperature of the overall ink discharge target width of the line type ink jet head reaches the appropriate temperature range as in the related art is avoided.

Accordingly, the completion of the execution of the print job can be hastened in the situation that the difference in the ink temperature occurs depending on the position in the line type ink jet head and, further, in the case where the ink temperature of the line type ink jet head is out of the appropriate temperature range during the execution of the print job.

According to the second aspect of the present invention, the rotation of the image data is controlled so that the direction of the short side or the long side of the rectangular area becomes the print width direction and the image forming becomes possible through the line type ink jet head in the first ink discharge target width or the second ink discharge target width, depending on the number of recording media used for the execution of the print job based on the result of the comparison of the sum of the first execution time and the first warm-up time with the sum of the second execution time and the second warm-up time.

If the number of recording media is small, the sum of the first execution time and the first warm-up time becomes smaller than the sum of the second execution time and the second warm-up time.

That is, the influence of the warm-up time becomes greater than the influence of the transport time due to the length along the transport direction of the recording medium. Because of this, the completion of the execution of the print job can be hastened by hastening the first printing (start of the execution of the print job) through hastening of the warm-up time. In this case, the completion of the execution of the print job can be certainly hastened by controlling the rotation of the image data so that the short side of the rectangular area becomes the print width direction and the image forming becomes possible through the line type ink jet head in the first ink discharge target width.

On the other hand, if the number of recording media is large, the sum of the second execution time and the second warm-up time becomes smaller than the sum of the first execution time and the first warm-up time. That is, the influence of the transport time due to the length along the transport direction of the recording medium becomes greater than the influence of the warm-up time. Because of this, the warm-up time becomes slow, but the length along the transport direction of the recording medium is shortened, and thus the completion of the execution of the print job can be hastened through the start of the execution of the print job.

In this case, the completion of the execution of the print job can be certainly hastened by controlling the rotation of the image data so that the long side of the rectangular area becomes the print width direction and the image forming becomes possible through the line type ink jet head in the first ink discharge target width.

According to the third aspect of the present invention, the following effects are obtained. That is, the following effects are obtained by determining the number of recording media which causes the change of the size correlation between the time (the sum of the warm-up time and the print job execution time) that is necessary to complete the execution of the print job through imaging onto the recording medium with the first ink discharge target width and the time that is necessary to complete the execution of the print job through imaging onto the recording medium with the second ink discharge target width, as the predetermined number.

That is, since it is possible to certainly perform imaging onto the recording medium with the ink discharge target width where the time obtained by summing the warm-up time and the print job execution time is shorter depending on the number of recording media, the completion of the execution of the print job can be hastened more certainly.

According to the fourth aspect of the preset invention, if the number of recording media that are used to execute the printing job is equal to or larger than the predetermined number, the rotation of the image data is first controlled so that the direction of the short side of the rectangular area becomes the print width direction and the imaging onto the recording medium becomes possible with the first ink discharge target width as the ink discharge target width. Thereafter, if it is determined that the ink temperature of the second ink discharge target width is in the appropriate temperature range by the appropriate temperature range determination means, the rotation of the image data is controlled so that the direction of the long side of the rectangular area becomes the print width direction with the second ink discharge target width as the ink discharge target width.

Through this, by shortening the warm-up time for making the ink temperature that is out of the appropriate temperature range reach the appropriate temperature range, the first printing may be hastened and the transport time of the recording medium may be shortened. As a result, the completion of the execution of the print job can be hastened much more certainly.

BRIEF DESCRIPTION OF THE DRAWINGS

FIG. 8 is a diagram illustrating a table that corresponds to a predetermined block according to the first embodiment;

FIG. 10 is a diagram illustrating a warm-up time table according to the first embodiment;

DETAILED DESCRIPTION OF THE INVENTION

First Embodiment

Configuration of Printing System

Figure 1:
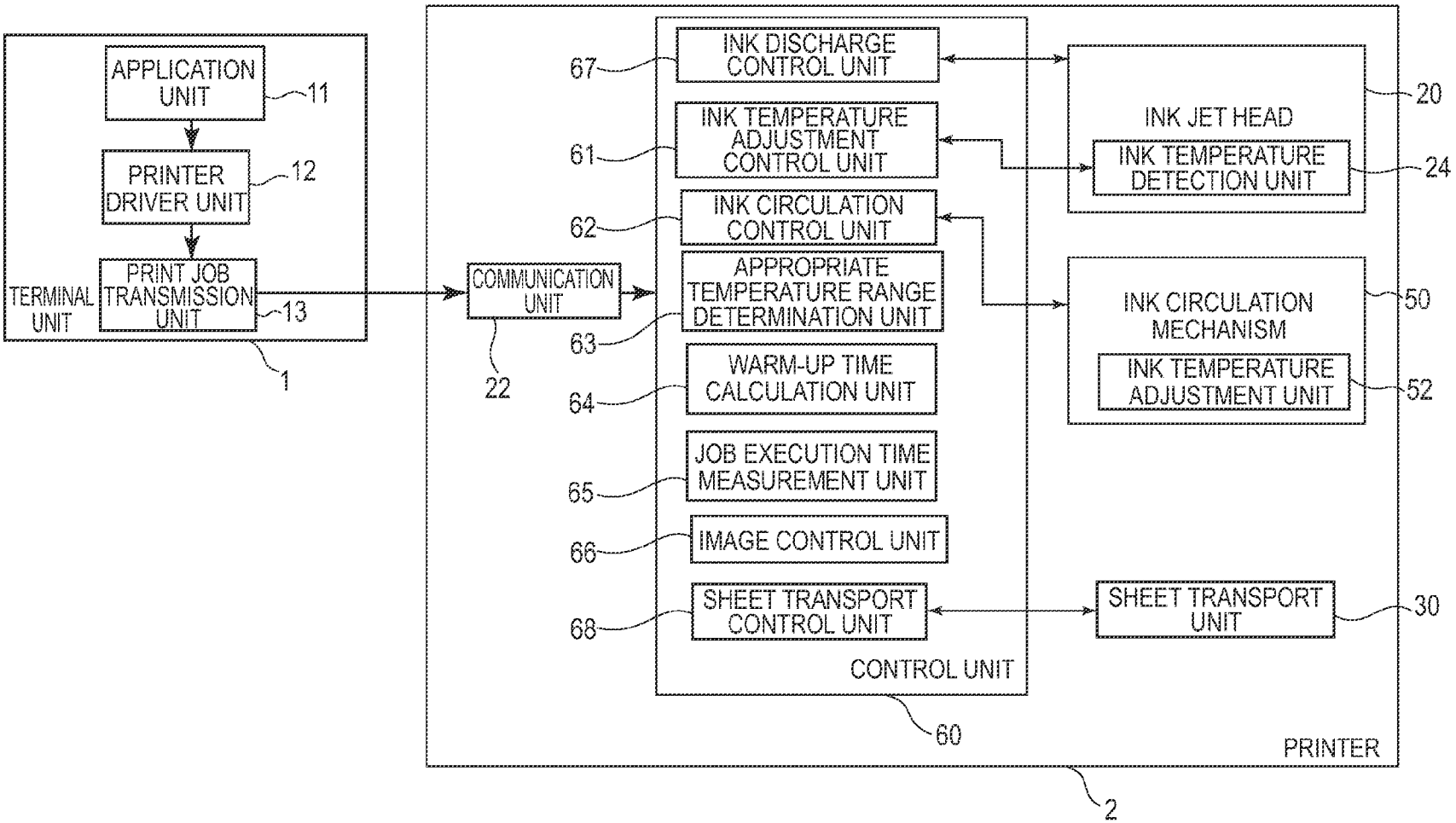
FIG. 1 is a block diagram illustrating the configuration of a printing system according to a first embodiment.

As shown in FIG. 1, a printing system includes a terminal unit 1 in which an operation system for performing a basic operation such as a user interface is installed and which can execute various kinds of software, an ink jet printer 2, and a system communication unit (not illustrated) connecting the terminal unit 1 and the ink jet printer 2 through a network such as a wired LAN.

Configuration of Terminal Unit

The terminal unit 1 includes an application unit 11 generating image data, such as letters, various objects, and photographs, a printer driver unit 12, an input/output unit (not illustrated), and a print job transmission unit 13. The application unit 11 and the printer driver unit 12 are configured so that a program installed in the terminal unit 1 performs processes such as decryption or the like though a CPU or the like. Image data generated by the application unit 11 is output to the printer driver unit 12.

The application unit 11 generates image data to form an image in a predetermined rectangular area (hereinafter referred to as a "predetermined area") on a rectangular printing sheet. Specifically, the application unit 11 generates the image data so that various kinds of image information are included in the predetermined area which is included in an area on the A4 size (210 mm×297 mm) printing sheet and is similar to the shape of the printing sheet.

Explanations will be made on the assumption that the image data is data that includes various kinds of image information in the predetermined area. Explanations will be made on the assumption that the predetermined area has a long side with a length of 290 mm and a short side with a length of 200 mm.

The printer driver unit 12 makes the output function of an input/output unit perform display of a print operation screen, a print setting screen, and the like. The printer driver unit 12 receives print setting from a user through the input function of the input/output unit, and notifies the user of setting information on the printing or print state through the output function of the input/output unit.

Further, by the print setting through the printer driver unit 12, the direction of the long side of the printing sheet may be the transport direction of the printing sheet or the direction of the short side of the printing sheet may be the transport direction of the printing sheet. In the following description, explanation will be made in the case where the direction of the long side of the printing sheet becomes the transport direction of the printing sheet. In this case, the long side of the predetermined area becomes parallel to the transport direction of the printing sheet.

The printer driver unit 12 generates print target job data (for example, PDL data) based on data set by the user (hereinafter referred to as "print setting data") and image data, and outputs the print target job data to an ink jet printer 2 through the print job transmission unit 13 and a system communication unit.

The print target job data includes target image data of which image forming is performed by an ink jet head and the print setting data with respect to a printing sheet. In the case where the print target job data is to make the ink jet head perform imaging on a plurality of printing sheets, it includes image data for each page.

The print setting data includes printing sheet number data that indicates the number of printing sheets that is imaged by the print job target data. The print setting data further includes printing sheet direction data which indicates, for example, that the direction of the long side of the printing sheet is set to the transport direction of the printing sheet and the direction of the short side of the printing sheet is set to the width direction (hereinafter referred to as the "print width direction) that is orthogonal to the transport direction of the printing sheet (hereinafter referred to the "sheet transport direction"), and size data of the printing sheet (for example, A4 size, that is, 297 mm×210 mm) for printing the image data.

Configuration of Ink Jet Printer

The ink jet printer 2 acquires the print target job data transmitted from the terminal unit 1 and executes the print target job data using a line type ink jet head (hereinafter simply referred to as an "ink jet head").

The ink jet printer 2 includes a communication unit 22 that receives the print target job data transmitted from the terminal unit 1, an ink jet head 20, an ink temperature detection unit 24 installed in the ink jet head 20, a sheet transport unit 30, an ink circulation mechanism 50, and a control unit 60 that controls the respective units.

Ink Jet Head

Figure 2:
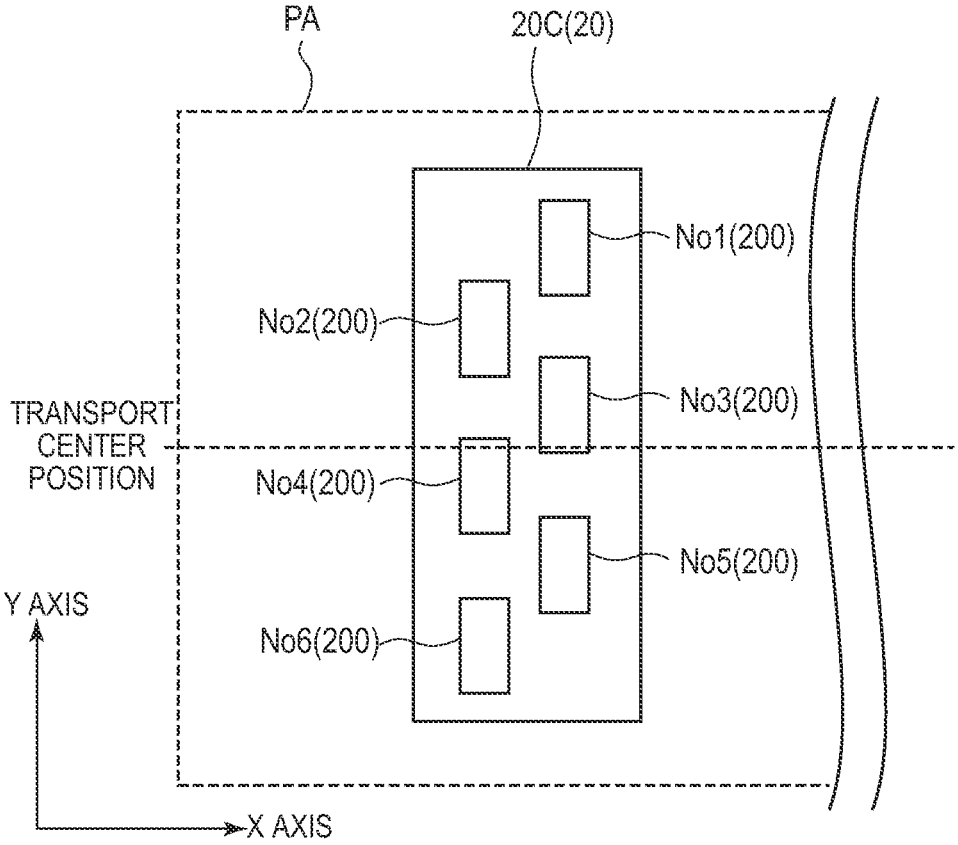
FIG. 2 is a view illustrating the configuration of a part of an ink jet head according to the first embodiment.
Figure 3:
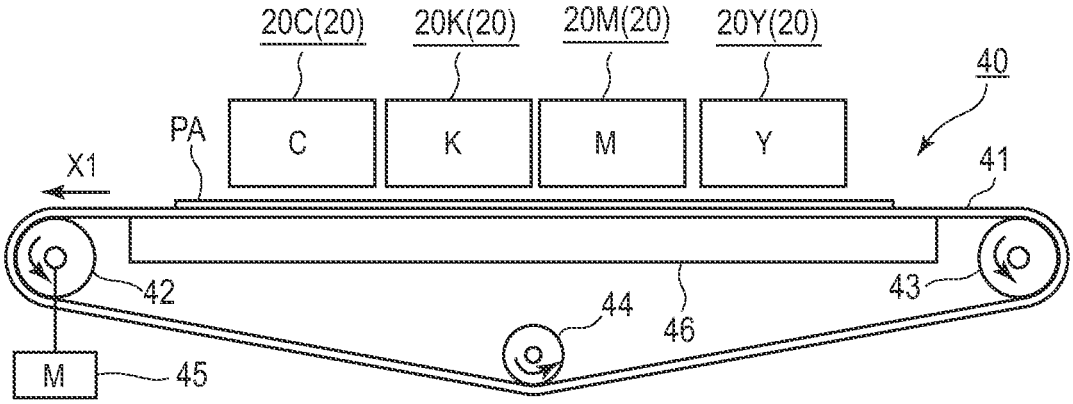
FIG. 3 is a view illustrating the configuration of an ink jet head and a middle transport unit according to the first embodiment.

The ink jet head 20 performs imaging at predetermined intervals in the print width direction, with respect to the printing sheet, through ink discharge. FIGS. 2 and 3 are views illustrating the configuration of the ink jet head 20. FIG. 2 is a view of the ink jet printer as seen from an upper side, and FIG. 3 is a view of the ink jet printer as seen from a front side.

In the ink jet printer 2 according to this embodiment, four ink jet heads 23 are installed in the order of Y (Yellow), M (Magenta), K (Black), and C (Cyan) along the sheet transport direction (X-axis direction). The printing sheet is imaged in the unit of a line by ink discharged from the respective ink jet heads 20 while being transported in the sheet transport direction.

In each ink jet head 20, as shown in FIG. 2, two lines, each of which includes three head blocks 200 that are arranged in the Y-axis direction (sheet width direction), are arranged in the X-axis direction (sheet transport direction). The respective head blocks 200 are alternately arranged in a zigzag form so that parts of the respective head blocks overlap each other in the adjacent lines. Through this, in the ink jet head 20, it may be considered that, with respect to the sheet transport center position of the width in the Y-axis direction, head block Nos. 1 and 6 are arranged in the end portion, head block Nos. 3 and 4 are arranged in the center portion, and head block 230 Nos. 2 and 5 are arranged in the middle portion between the center portion and the end portion.

In this embodiment, it is assumed that ink jet heads of the type to jet ink using piezoelectric elements are used.

In the ink jet head 20, a driver (not illustrated) is provided to output a driving signal for driving the piezoelectric element based on an ink discharge amount for each pixel position on the predetermined area of the image data that is sent from the control unit 60. In the case of selectively discharging the ink from a plurality of nozzles installed on the head blocks 200, the ink in an ink storage chamber is discharged from the nozzle by displacing a vibrating plate through application of the driving signal to each piezoelectric element that is installed to correspond to each nozzle. However, the present invention is not limited thereto, but an electrostatic method or a film boiling ink jet method is also applicable.

Ink Temperature Detection Unit

The ink temperature detection unit 24 detects the ink temperature depending on the position in the sheet width direction (Y-axis direction) in the ink jet head 20. Specifically, the ink temperature detection unit 24 installed in each head block 200 detects the ink temperature in each head block 200 (Nos. 1 to 6).

Sheet Transport Unit

The sheet transport unit 30 includes a sheet feed unit (not illustrated) that feeds a printing sheet and transports the printing sheet to a middle transport unit 40, the middle transport unit 40 that images the printing sheet fed from the sheet feed unit by the ink discharge through the ink jet head 23 while transporting the printing sheet in the sheet transport direction and transports the imaged printing sheet to a sheet eject unit (not illustrated), and the sheet eject unit that discharges the printing sheet transported by the middle transport unit 40.

In the sheet feed unit, a plurality of feed trays (not illustrated) on which various printing sheets are loaded are installed. The plurality of feed trays include a feed tray on which printing sheets are loaded so that the sheet transport direction becomes the direction of the long side of the printing sheet, and a feed tray on which printing sheets are loaded so that the sheet transport direction becomes the direction of the short side of the printing sheet.

The middle transport unit 40 is installed below the respective ink jet heads 20C, 20K, 20M, and 20Y as shown in FIG. 3. The middle transport unit 40 includes a belt-shaped belt platen 41 on which a plurality of air absorption holes (not illustrated) are penetratingly formed at approximately equal intervals, first to third pulleys 42 to 44 that build the belt-shaped belt platens 41 thereon, a motor 45 connected to the first pulley 42 to rotate the belt-shaped belt platen 41, and a suction box 46 that sucks air from the plurality of air absorption holes formed on the belt platen 41.

For example, when an A4 size printing sheet PA is loaded on the belt-shaped belt platen 41, the printing sheet PA is fixed onto the belt platen 41 by sucking air from the plurality of air absorption holes formed on the belt platen 41. The printing sheet PA that is in a fixed state is transported in the sheet transport direction (direction of an arrow X1) by the rotation of the belt platen 41, and an image is formed by the ink discharged from the respective ink jet heads 20.

As shown in FIG. 2, in the middle transport unit 40, the transporting of the printing sheet is performed so that the center position in the sheet width (print width) direction (Y-axis direction) of the ink jet head 20 coincides with the center position in the Y-axis direction of the printing sheet.

Ink Circulation Mechanism

Figure 4:
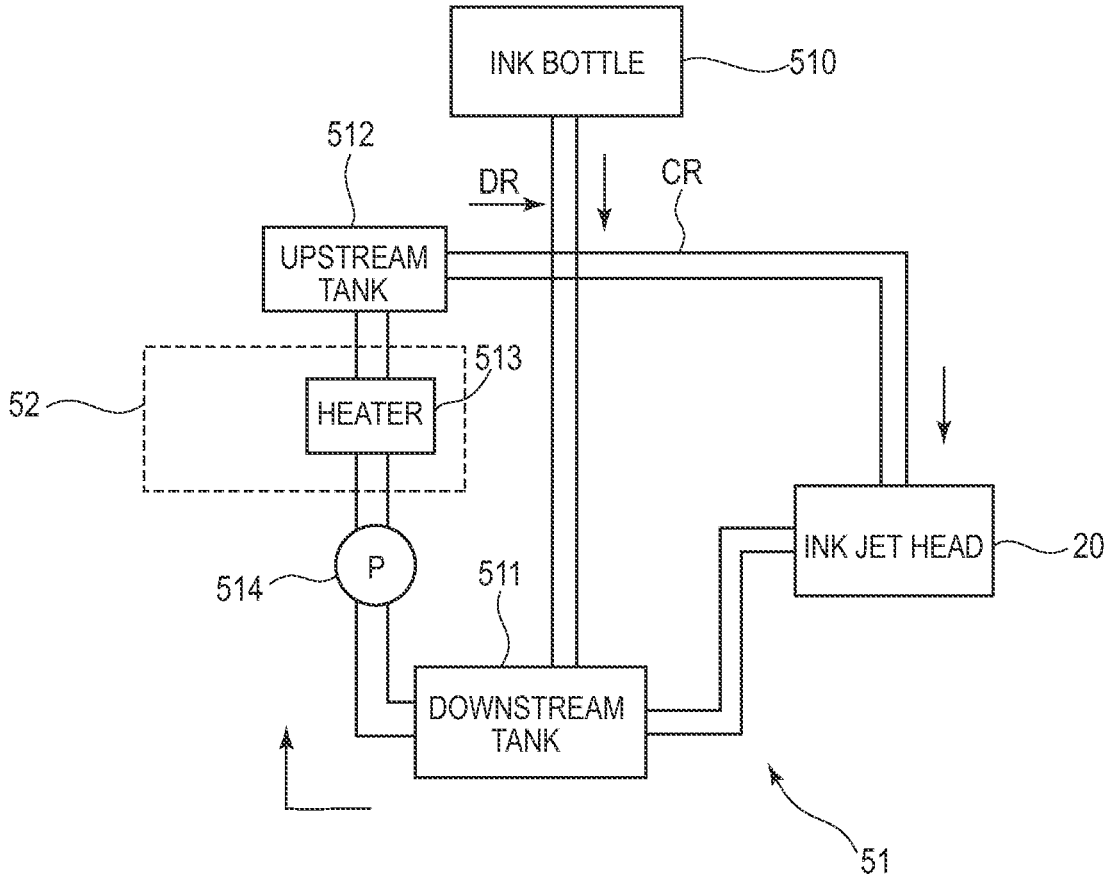
FIG. 4 is a diagram illustrating the configuration of an ink circulation mechanism according to the first embodiment.

FIG. 4 is a schematic configuration diagram of an ink circulation mechanism 50. In this embodiment, as an example, on the assumption that the ink circulation mechanism 50 is installed for each color, except for an ink temperature adjustment unit 52 to be described later, the configuration of the ink circulation mechanism 50 for one color will be described.

The ink circulation mechanism 50 includes an ink circulation path unit 51 and an ink temperature adjustment unit 52. Here, as an example, a common ink temperature adjustment unit 52 is installed with respect to the ink circulation mechanisms 50 that correspond to the respective colors.

The ink circulation path unit 51 includes an ink bottle 510, a downstream tank 511, an upstream tank 512, and a pump 514. Further, the ink circulation path unit 51 includes a supply flow path DR connected from the ink bottle 510 to the downstream tank 511, and a circulation flow path CR that makes the ink pass through the downstream tank 511, the upstream tank 512, and the ink jet head 20 and then return to the downstream tank 511.

The ink supplied from the ink bottle 510 passes through the supply flow path DR and is temporarily stored in the downstream tank 511. Further, in the circulation flow path CR, the ink stored in the downstream tank 511 is sent to the upstream tank 512 by the pump 514, and then is introduced to the ink jet head 20. The ink that has not been used for print in the ink jet head 20 returns to the downstream tank 511.

The ink discharge surface of the ink jet head 20 is arranged at a position that is higher than the downstream tank 511, and the upstream tank 512 is arranged at a position that is higher than the ink discharge surface of the ink jet head 20. By the waterhead difference based on this position correlation, the ink supply from the upstream tank 512 to the ink jet head 20 and the ink return from the ink jet head 20 to the downstream tank 511 are performed.

The ink temperature adjustment unit 52 performs a warm-up operation to make the ink temperature in the ink jet head 20 reach an appropriate temperature range. The ink temperature adjustment unit 52 is installed between the downstream tank 511 and the upstream tank 512, and is provided with a heater 513 to warm the ink (further, the ink temperature adjustment unit 52 is also provided with an ink cooler (not illustrated) to cool the ink. The ink cooler has a heat sink and a cooling fan to increase the cooling effect is installed in the neighborhood of the heat sink of the ink cooler).

An appropriate temperature range of the ink, in which the ink jet printer 2 can perform printing with a predetermined quality or more, has been determined. When the ink temperature adjustment unit 52 performs the warm-up operation to make the ink temperature reach the appropriate temperature range, the heater operates in a state where the ink circulation is performed in the ink flow path of the ink circulation path unit 51. Since the ink that is warmed by the heater is circulated through the respective head blocks of the ink jet head 20, the ink temperatures in the respective head blocks 20 can reach the appropriate temperature range. If the ink temperatures reach the appropriate temperature range, the operation of the heater is turned off, and if the ink temperature rises too high to be out of the appropriate temperature range, the operation of the ink cooler is turned on. Accordingly, while the ink is circulated, the ink temperatures in the respective head blocks are adjusted to be in the appropriate temperature range.

In this embodiment, it is exemplified that while the ink jet printer 2 is in a power-on state, the ink temperature adjustment unit 52 adjusts the ink temperature of the ink jet head 20 so that the ink temperature is within the appropriate temperature range.

Control Unit

The control unit 60 includes an ink temperature adjustment control unit 61, an ink circulation control unit 62 that controls the pump 514 to circulate the ink in the ink circulation mechanism 50, an appropriate temperature range determination unit 63, a warm-up time calculation unit 64, a job execution time measurement unit 65, an image control unit 66, an ink discharge control unit 67, and a sheet transport control unit 68. In this embodiment, as an example, under the assumption that four head blocks 200 have the same temperature distribution in the width direction (Y-axis direction in FIG. 2), explanation will be made with respect to one ink jet head 20.

Ink Temperature Adjustment Control Unit

The ink temperature adjustment control unit 61 controls the ink temperature adjustment unit 52 to make the ink temperature in each head block 200 reach the appropriate temperature range based on the result of detecting the ink temperature by the ink temperature detection unit 24 that is installed in the predetermined head block 200 of the ink jet head 20.

Specifically, the ink temperature adjustment control unit 61 starts or continues the operation of the heater if the ink temperature detected by the ink temperature detection unit 24 installed in the predetermined head block No. 3 does not reach the predetermined temperature (any one of Ta, Tb, and Tc). On the other hand, if the ink temperature detected by the ink temperature detection unit 24 installed in the predetermined head block No. 3 reaches the predetermined temperature, the ink temperature adjustment control unit 61 stops the operation of the heater. The reason why to perform the ink temperature adjustment in the case where the ink temperature detected by the ink temperature detection unit 24 installed in the predetermined head block No. 3 does not reach the predetermined temperature (any one of Ta, Tb, and Tc) will be described in detail in the description of the processing of the appropriate temperature range determination unit 63.

Appropriate Temperature Range Determination Unit

When the communication unit 22 receives print target job data, the appropriate temperature range determination unit 63 determines whether or not the ink temperature in the ink jet head 20 is in the appropriate temperature range in a first ink discharge target width where the ink discharge is possible in a short side of a predetermined area included in image data and in a second ink discharge target width where the ink discharge is possible in a long side of the predetermined area. The details of the determination processing of the appropriate temperature range will be described hereinafter.

First, the appropriate temperature range determination unit 63 maintains ink temperature distribution data (hereinafter referred to as "ink temperature distribution data") for each head block 200 as follows. The ink temperature distribution data is generated as follows.

Figure 5:
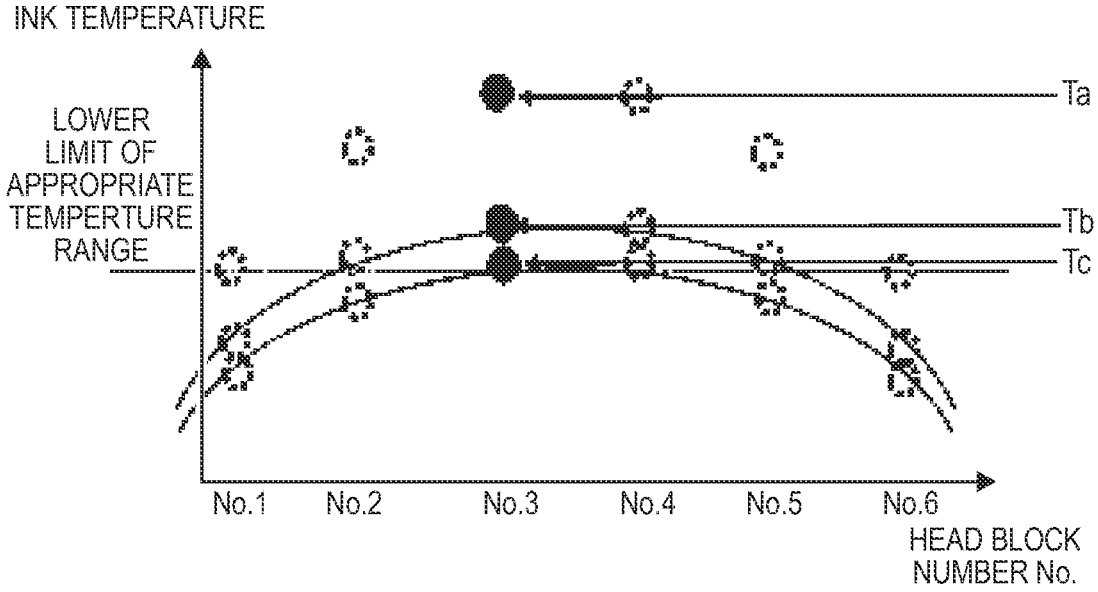
FIG. 5 is a supplementary diagram explaining processing of an appropriate temperature range determination unit according to the first embodiment.
Figure 6:
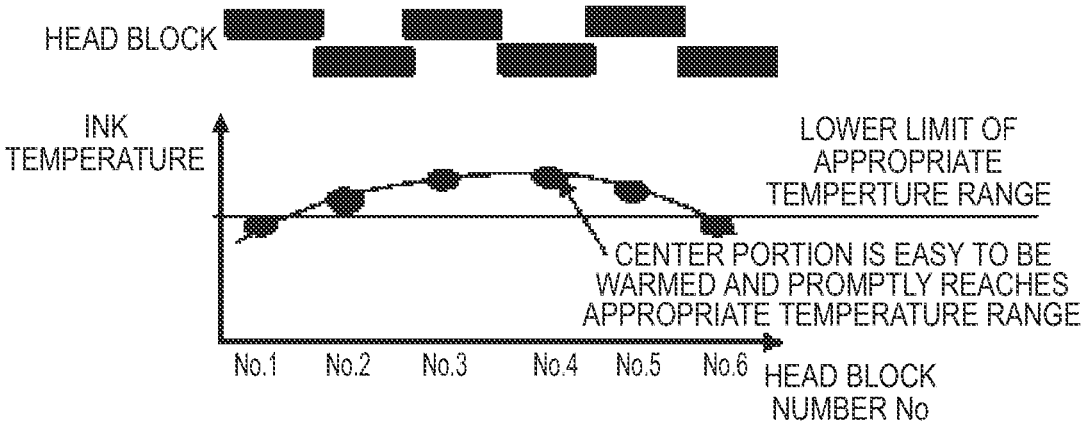
FIG. 6 is a diagram showing different states of ink temperature tendencies depending on the position of a head block according to the first embodiment.
Figure 7:
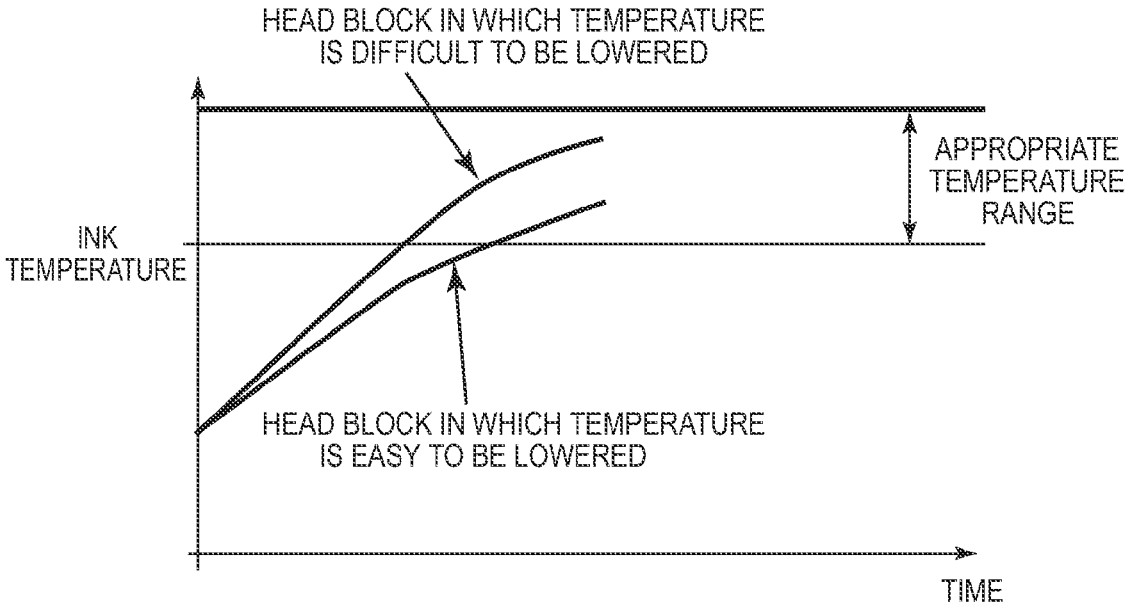
FIG. 7 is a diagram illustrating different states of ink temperature tendencies depending on the position of a head block according to the first embodiment.

FIG. 5 is a diagram illustrating the behavior of the ink temperature (black circle) detected by the ink temperature detection unit 24 in each of the head blocks 200 (Nos. 1 to 6) and the ink temperature (dotted circle) to be detected in the case where the warm-up operation is performed by the heater 513 from outside of the appropriate temperature range. Here, as shown in FIGS. 6 and 7, the ink of the head block 200 in the center portion is easy to be warmed and it is early that the ink temperature reaches the appropriate temperature range, whereas the ink of the head block 200 in the end portion is difficult to be warmed and it is late that the ink temperature reaches the appropriate temperature range.

If the ink temperature of the predetermined head block 200 (here, No. 3) is T×1 (in the neighborhood of the appropriate temperature range), a worker obtains the distribution of the ink temperatures of the head block Nos. 1 to 6 by detecting the ink temperatures of the other head blocks 200. In the same manner, the worker obtains the distribution of the ink temperatures of the head block Nos. 1 to 6 if the ink temperature of the predetermined head block 200 (here, No. 3) is T×2 (in the neighborhood of the appropriate temperature range).

By the result of the distribution, the worker can calculate the change of temperature rise of the other head blocks 200 with respect to the change of temperature rise of the head block No. 3 from T×1 to T×2, in the neighborhood of the appropriate temperature range.

The worker can obtain the ink temperature Ta of the head block No. 3 for making the ink temperatures of all the head blocks 200 (Nos. 1 to 6) reach the appropriate temperature range, from the change of temperature rise at the ink temperatures T×1 and T×2 of the head block No. 3 and the change of temperature rise of the other head blocks 200. In the same manner, the worker can obtain the ink temperatures Tb and Tc of the head block No. 3 for making the ink temperatures of the head blocks 200 (Nos. 2 to 5 and Nos. 3 and 4) reach the appropriate temperature range. An example that plots these results is shown in FIG. 5.

If the ink temperature of the predetermined head block 200 in the center portion is out of the appropriate temperature range in the case where the ink temperature of the head block 200 in the end portion enters the appropriate temperature range, the following may be performed. For example, a separate ink temperature adjustment unit 52 may be installed in the head block 200 in the center portion to make the ink temperatures of all the head blocks 200 enter the appropriate temperature range.

The appropriate temperature range determination unit 63 maintains the ink temperature Ta of the head block No. 3 to make the ink temperatures of all head blocks Nos. 1 to 6 reach the appropriate temperature range, the ink temperature Tb of the head block No. 3 to make the ink temperatures of four head blocks Nos. 2 to 5 in the center reach the appropriate temperature range, and the ink temperature Tc of the head block No. 3 to make the ink temperatures of two head blocks Nos. 3 and 4 in the center reach the appropriate temperature range.

The appropriate temperature range determination unit 63 maintains discharge target width data that indicates ink discharge target widths of all head blocks Nos. 1 to 6, ink discharge target widths of four head blocks Nos. 2 to 5 in the center, and ink discharge target widths of two head blocks Nos. 3 and 4 in the center. The correlation between the ink temperature values Ta, Tb, and Tc of the head block No. 3 and the ink discharge target widths 330 mm, 220 mm, and 110 mm is maintained as a predetermined table for block shown in FIG. 8.

Figure 9:
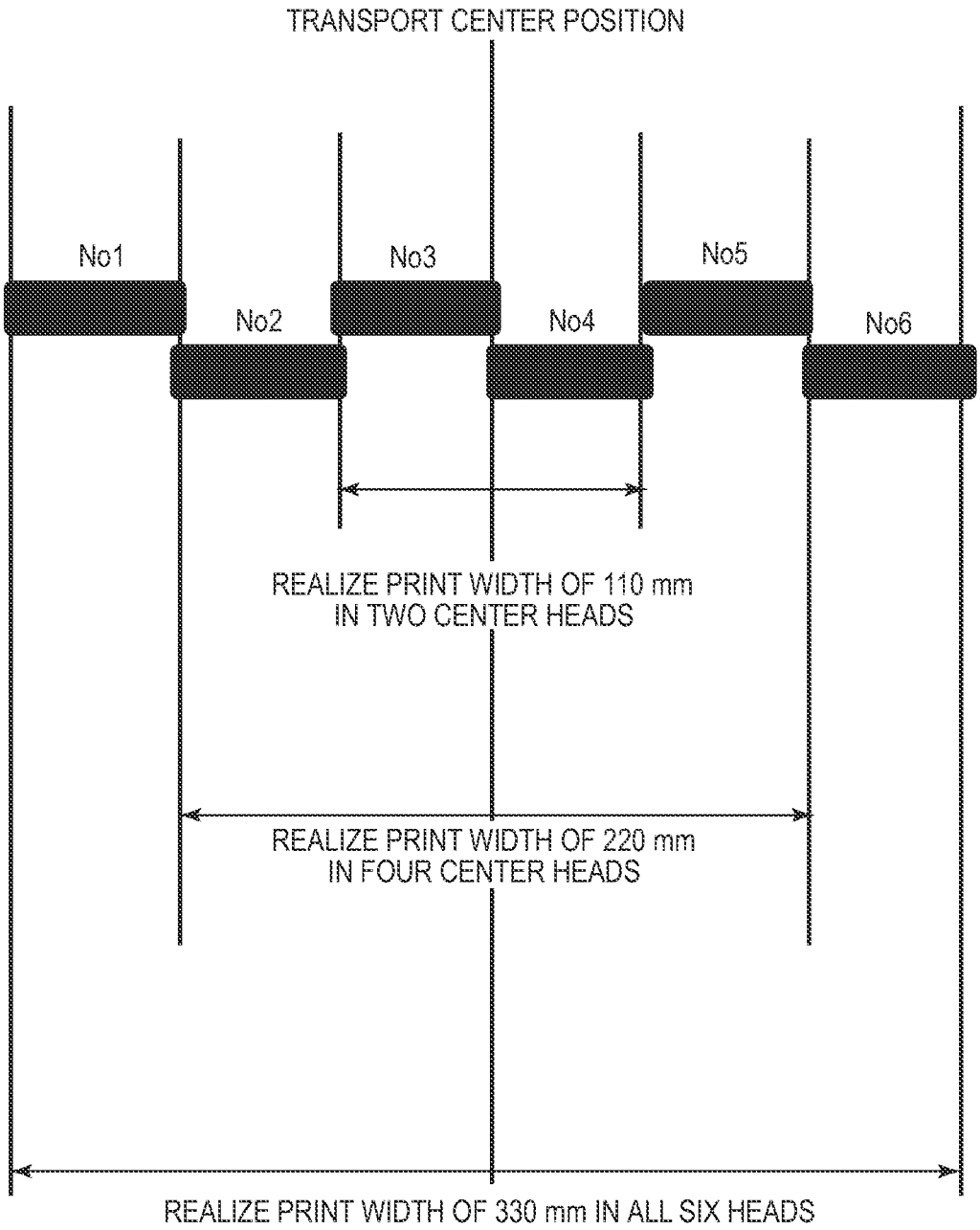
FIG. 9 is a diagram illustrating printable widths according to respective head blocks according to the first embodiment.

The print target job data, which is received by the communication unit 22, is sent to the image control unit 66. The image control unit 66 sends to the appropriate temperature range determination unit 63 that the length of the long side of the predetermined area in the image data is the length along the sheet transport direction (X-axis direction shown in FIG. 2) and the length of the short side of the predetermined area in the image data is the length along the print width direction (Y-axis direction shown in FIG. 2) from printing sheet direction data and printing sheet size data. FIG. 9 shows a printable width (ink discharge target width) according to the respective head blocks 200.

For example, in the image control unit 66, the length of the long side of the predetermined area in the image data (290 mm, printable with the ink discharge target width by all head blocks Nos. 1 to 6, unprintable with the ink discharge target width by four head blocks Nos. 2 to 5 in the center) is the length along the sheet transport direction. Further, the length of the short side of the predetermined area in the image data (200 mm, printable with the ink discharge target width by four head blocks Nos. 2 to 5 in the center, unprintable with the ink discharge target width by two head blocks Nos. 3 and 4 in the center) is acquired as the length along the print width direction.

The appropriate temperature range determination unit 63 periodically acquires the ink temperature $T_z$ that is detected by the ink temperature detection unit 24 installed in the head block No. 3. The appropriate temperature range determination unit 63 obtains the large and small correlation between the ink temperature Tz and Ta to Tc by comparing the acquired ink temperature Tz with the maintained ink temperatures Ta to Tc.

For example, if the length (290 mm) of the long side of the predetermined area in the image data is the length along the sheet transport direction, and the length (200 mm) of the short side of the predetermined area in the image data is the length along the print width direction, determination is made as follows.

If the ink temperature Tz reaches the ink temperature Ta, it is determined that the ink temperatures are within the appropriate temperature range both in the ink discharge target width (the second ink discharge target width) of the ink jet head 20 that corresponds to the length of the long side of the predetermined area in the image data (ink discharge is possible for the length) and in the ink discharge target width (the first ink discharge target width) of the ink jet head 20 that corresponds to the length of the short side of the predetermined area in the image data (ink discharge is possible for the length).

If the ink temperature Tz reaches the ink temperature Tb, it is determined that the ink temperature in the ink discharge target width of the inject head 20 that corresponds to the length of the long side of the predetermined area is out of the appropriate temperature range, but the ink temperature in the ink discharge target width of the ink jet head 20 that corresponds to the length of the short side of the predetermined area is within the appropriate temperature range.

If Tz does not reach Tc, it is determined that the ink temperatures both in the ink discharge target width of the inject head 20 that corresponds to the length of the long side of the predetermined area and in the ink discharge target width of the ink jet head 20 that corresponds to the length of the short side of the predetermined area are out of the appropriate temperature range.

Warm-Up Time Calculation Unit

The warm-up time calculation unit 64 calculates two warm-up times until the ink temperature in the ink discharge target width of the ink jet head 20, which is determined to be out of the appropriate temperature range by the appropriate temperature range determination unit 63, reaches the appropriate temperature range.

The warm-up time calculation unit 64 maintains a warm-up time table that indicates the warm-up time until the ink temperature of the head block No. 3 reaches Ta, Tb, and Tc for each ink temperature before the start of the warm-up operation in the case where the ink temperature adjustment unit 52 is used. As an example, a warm-up time table until the ink temperature reaches the ink temperature Ta is shown in FIG. 10. This warm-up time table may be separately provided depending on the environmental temperature and the temperature adjustability (warming efficiency) of the ink temperature adjustment unit 52.

An example of a detailed description of the calculation process by the warm-up time calculation unit 64 will be shown hereinafter. For example, if the length 290 mm of the long side of the predetermined area in the image data is the length along the sheet transport direction, and the length 200 mm of the short side of the predetermined area in the image data is the length along the print width direction, the following process is performed. If it is determined that the ink temperatures of the head blocks 200 (Nos. 1 to 6 and Nos. 2 to 5) corresponding to both the length of the long side of the predetermined area and the length of the short side of the predetermined area are within the appropriate temperature range, the warm-up time calculation unit 64 acquires the ink temperature Tz of the head block No. 3.

Then, the warm-up time calculation unit 64 acquires the ink temperature Ta of the head block No. 3 in the case where the ink temperatures of the head blocks Nos. 1 to 6 that correspond to the length of the long side of the predetermined area reach the appropriate temperature range and the ink temperature Tb of the head block No. 3 in the case where the ink temperatures of the head blocks Nos. 2 to 5 that correspond to the length of the short side of the predetermined area reach the appropriate temperature range.

The warm-up time calculation unit 64 calculates the warm-up times until the ink temperature Tz of the head block No. 3 reaches the ink temperatures Ta and Tb with reference to the warm-up time table. The former warm-up time is the warm-up time (second warm-up time) until the ink temperatures of the head blocks Nos. 1 to 6 that correspond to the length of the long side of the predetermined area reach the appropriate temperature range, and the latter warm-up time is the warm-up time (first warm-up time) until the ink temperatures of the head blocks Nos. 1 to 6 that correspond to the length of the short side of the predetermined area reach the appropriate temperature range.

Job Execution Time Measurement Unit

The job execution time measurement unit 65 measures a first job execution time until the execution of the print target job data, which has started using the ink jet head 20 in the ink discharge target width that corresponds to the length of the short side of the predetermined area, is completed and a second job execution time until the execution of the print target job data, which has started using the ink jet head 20 in the ink discharge target width that corresponds to the length of the long side of the predetermined area, is completed for every number of printing sheets (hereinafter referred to as the "number of printing sheets") used for the execution of the print target job data.

In the case of transporting the printing sheet by the sheet transport unit 30, it is necessary to narrow the interval between the printing sheets as much as possible for the rapidity of the printing. If the interval is too narrow, collision of printing sheets occurs. Due to this, the interval of the printing sheets is determined as a predetermined interval based on the print conditions (the feed condition of the sheet feed unit, the transport condition of the middle transport unit 40, and the ink discharge speed (image forming speed), etc. by the ink jet head). The predetermined interval can occur in the same manner even if the sheet, for example, which is of A4 size, is transported in the direction of the long side or in the direction of the short side.

Because of this, the job execution time measurement unit 65 performs the following process based on the printing sheet direction data and the printing sheet size data using the sheet transport unit 30. For example, if the size of the printing sheet targeted for printing of the image data is A4 and the length along the transport direction of the printing sheet is set to 297 mm (the length from head block 1 to head block 6), the job execution time, which is the time from the time when an initial printing sheet that is used for the print job target data is fed until all printing sheets are printed by the ink jet head 20 and discharged, is measured for every number of printing sheets.

If the short side of the predetermined area is parallel to the print width direction, the job execution time corresponds to the first job execution time. On the other hand, if the long side of the predetermined area is parallel to the print width direction, the job execution time corresponds to the second job execution time.

In the same manner, the job execution time measurement unit 65 measures the job execution time in the case where the length along the transport direction of the printing sheet is set to 210 mm (the length from head block 2 to head block 5) for every number of printing sheets. Further, the job execution time measurement unit 65 measures the job execution time in the case where the print target size of the image data is A3, B4 or the like in the same manner. The job execution time measurement unit 65 maintains the results of the measurement for every number of printing sheets as the first job execution time and the second job execution time.

Image Control Unit 66

The image control unit 66 controls whether or not to rotate the image data in the orthogonal direction so that the image forming becomes possible through the line type ink jet head in the first ink discharge target width or the second ink discharge target width depending on the number of recording media used for the execution of the print job based on the result of comparison of the sum of the first job execution time and the first warm-up time with the sum of the second job execution time and the second warm-up time.

Specifically, if the number of printing sheets is equal to or smaller than a predetermined number, the image control unit 66 controls whether or not to rotate the image data in the orthogonal direction so that the image forming becomes possible through the ink jet head 20 in the first ink discharge target width, and if the number of printing sheets is larger than the predetermined number, the image control unit 66 controls whether or not to rotate the image data in the orthogonal direction so that the image forming becomes possible through the ink jet head 20 in the second ink discharge target width.

Specifically, if the print target job data is received by the communication unit 22, the image control unit 66 acquires the print target job data and performs the following process. The image control unit 66 performs the image processing of the print target job data. Specifically, the image control unit 66 performs deployment process such as a RIP process of the print target job data, and acquires the bitmap-deployed image data (hereinafter simply referred to as "image data") and print setting data (printing sheet number data, printing sheet direction data, and printing sheet size data)

The image control unit 66 performs color conversion processing of the image data, binarization processing, and middle adjustment processing. The image data after the image processing is expressed as dot data, and the image control unit 66 stores the dot data in a dot data storage unit (not illustrated) that is a storage area on a memory. The dot data is, for example, data indicating 1 to 7 drops, and corresponds to respective pixel positions in the predetermined area.

As described above, by the warm-up time calculation unit 64, the warm-up time (first warm-up time) until the ink temperature of the head block 200 that corresponds to the length of the short side of the predetermined area reaches the appropriate temperature range and the warm-up time (second warm-up time) until the ink temperature of the head block 200 that corresponds to the length of the long side of the predetermined area reaches the appropriate temperature range are calculated and sent to the image control unit 66.

Further, the image control unit 66 acquires the number of printing sheets included in the printing sheet number data, and acquires the job execution time in the case where the length (330 mm) of the head block 200 that corresponds to the length (for example, 290 mm) of the long side of the predetermined area in the image data (ink discharge is possible for the length) makes the ink discharge target width for every number of printing sheets.

Further, the image control unit 66 acquires the job execution time in the case where the length (for example, 220 mm) of the head block 200 in which the ink discharge is possible for the length (for example, 200 mm) of the short side of the predetermined area in the image data makes the ink discharge target width for every number of printing sheets.

Figure 11:
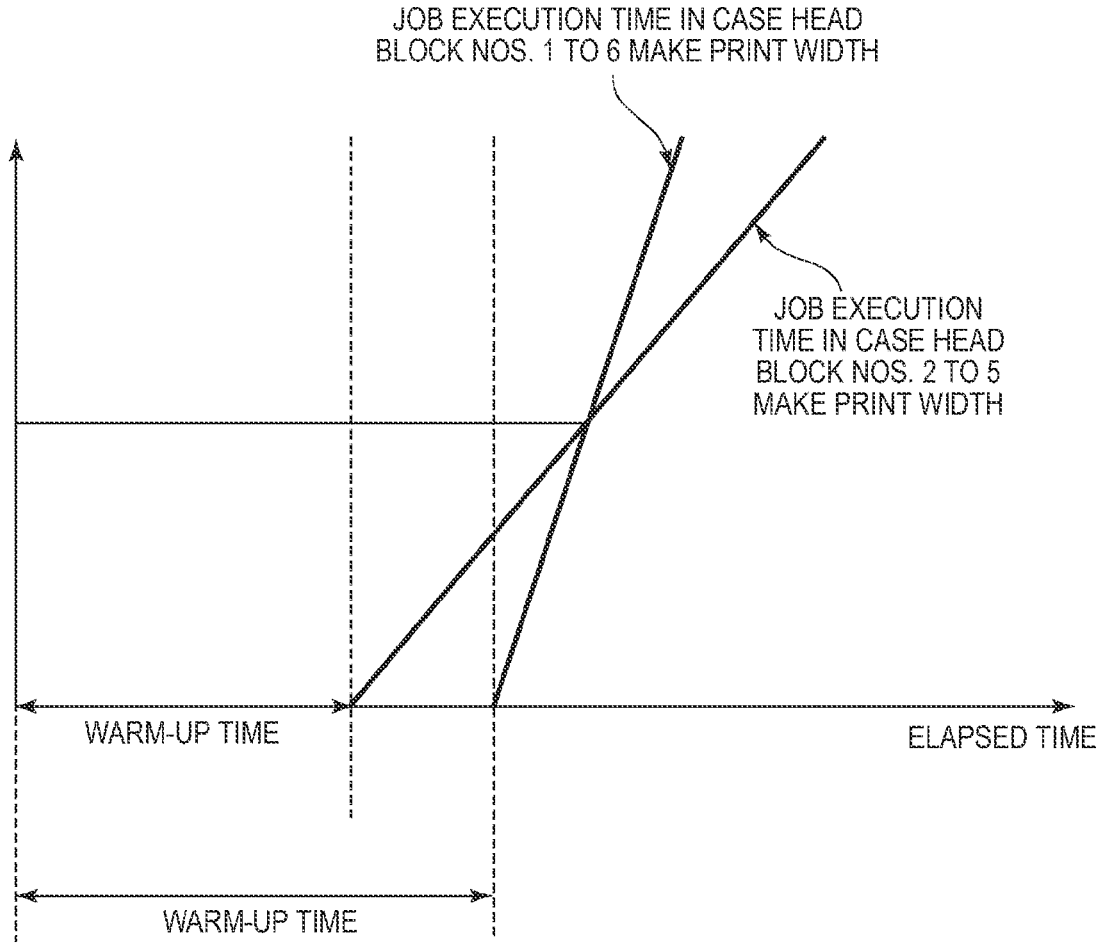
FIG. 11 is a diagram illustrating a job execution time graph according to the first embodiment.
Figure 12:
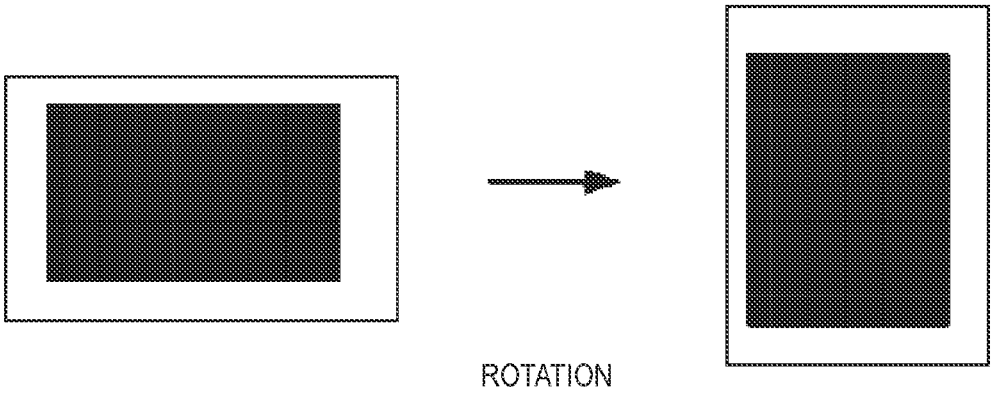
FIG. 12 is a supplementary diagram explaining an image rotating process by an image control unit according to the first embodiment.
Figure 13:
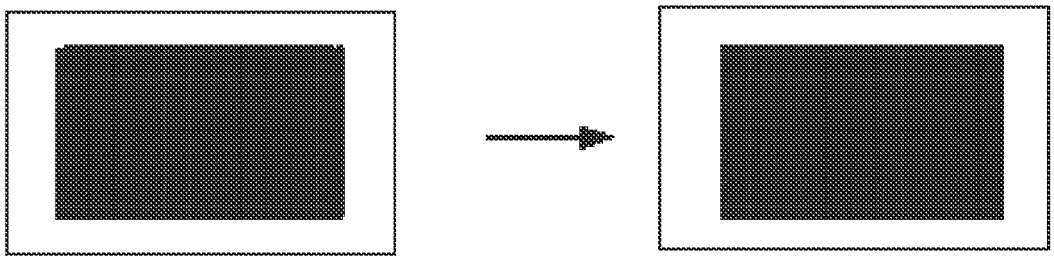
FIG. 13 is a supplementary diagram explaining an image rotating process by an image control unit according to the first embodiment.

Further, the image control unit 66 determines whether or not to rotate the image data from the acquired first warm-up time, the second warm-up time, the number of printing sheets included in the print setting data, and the job execution time for every number of printing sheets. FIGS. 11, 12, and 13 are diagrams explaining the image rotation control processing through the image control unit 66.

For example, if the size of the printing sheet targeted for printing of the image data is A4 size, the image control unit 66 generates the following job execution time graph from the acquired first warm-up time, the second warm-up time, and the job execution time for each number of printing sheets. That is, as shown in FIG. 11, the image control unit 66 generates the job execution time graph that indicates the job execution time in the case where the head blocks Nos. 1 to 6, in which the ink discharge is possible for the length of the long side of the predetermined area, make the ink discharge target width and the job execution time in the case where the head blocks Nos. 2 to 5, in which the ink discharge is possible for the length of the short side of the predetermined area, make the ink discharge target width when the number of printing sheets is represented by a vertical axis and the elapsed time after the ink jet printer acquires the print target job data is represented by a horizontal axis. Here, the horizontal axis shown in FIG. 11 may be the elapsed time from the power supply on time.

In this job execution time graph, if the number of printing sheets is equal to or smaller than L, the time point where the warm-up time and the job execution time have elapsed from the acquisition of the print target job data becomes earlier in the case where the head blocks Nos. 2 to 5 make the ink discharge target width. Because of this, it is determined that the head blocks Nos. 2 to 5 make the ink discharge target width. On the other hand, if the number of printing sheets is larger than L, the time point where the warm-up time and the job execution time have elapsed from the acquisition of the print target job data becomes earlier in the case where the head blocks Nos. 1 to 6 make the ink discharge target width. Because of this, it is determined that the head blocks Nos. 1 to 6 make the ink discharge target width.

The image control unit 66 determines that the head blocks Nos. 1 to 6, in which the ink discharge is possible for the length of the long side of the predetermined area, make the ink discharge target width or the head blocks Nos. 2 to 5, in which the ink discharge is possible for the length of the short side of the predetermined area, make the ink discharge target width, from the job execution time graph and the number of printing sheets included in the print setting data.

Further, the image control unit 66 includes a dot data rotation unit, and if necessary, the image control unit 66 rotates the dot data stored in a dot data storage unit 221 by 90 degrees and restores the rotated dot data in the dot data storage unit 221.

This process will be described in detail hereinafter using FIGS. 12 and 13. The image control unit 66 performs the following rotation control process, for example, in the case where the length of the long side of the predetermined area is set to 290 mm and the length of the short side of the predetermined area is set to 200 mm in the image data included in the print target job data, and the long side of the predetermined area becomes in parallel to the sheet transport direction.

If it is determined that the head blocks Nos. 1 to 6, in which the ink discharge is possible for the length (290 mm) of the long side of the predetermined area, make the ink discharge target width, the image control unit 66 rotates the respective dot data in the orthogonal direction and restores the rotated dot data in the dot data storage unit 221. FIG. 12 shows the image data before being restored and the image data after being restored. If it is determined that the head blocks Nos. 2 to 5, in which the ink discharge is possible for the length 200 mm of the short side of the predetermined area, make the ink discharge target width, the process of rotating the respective dot data in the orthogonal direction is not performed. As a result, the image data (set of the respective dot data) that is stored in the dot data storage unit 221 is not changed as shown in FIG. 13.

The image control unit 66 performs the following process with respect to the ink temperature adjustment control unit 61 while the warm-up operation is performed until the head block 200, which corresponds to the ink discharge target width in the case where the time point where the warm-up time and the job execution time have elapsed from the acquisition of the print target job data becomes earlier, reaches the predetermined ink temperature (for example, Tb) of the head block No. 3 that is in the appropriate temperature range. The image control unit 66 monitors the ink temperature that is detected by the ink temperature detection unit 24 installed in the head block No. 3, and if the ink temperature becomes the predetermined temperature, the image control unit 66 instructs the ink temperature detection unit 24 to notify the image control unit 66 of the detected ink temperature.

If data that indicates the restoring process or the reaching of the predetermined ink temperature (for example, Tb) of the head block No. 3 is acquired, the image control unit 66 performs the following process. The image control unit 66 instructs the ink discharge control unit 67 to perform printing on the printing sheet using the ink jet head 20 based on the dot data stored in the dot data storage unit. Further, the image control unit 66 instructs the sheet transport control unit 68 to start feeding of the printing sheet through the sheet feed unit.

Here, for example, if the above-described rotation is performed in the case where the size of the printing sheet is the A4 size and the direction of the long side of the predetermined area of the image data is parallel to the sheet transport direction, the following process is performed. The image control unit 66 instructs the sheet transport control unit 68 to feed the A4 size printing sheet from the feed tray where the printing sheets, of which the length along the sheet transport direction is 297 mm, are loaded.

Ink Discharge Control Unit and Sheet Transport Control Unit

The ink discharge control unit 67 calculates the ink discharge amount for each pixel position based on the dot data after the image process that is stored in the dot data storage unit, and outputs the calculated ink discharge amount to the driver of the ink jet head 20.

The sheet transport control unit 68 controls the operations of the sheet feed unit, the middle transport unit 40, and the sheet eject unit to perform the feed transport, middle transport, and sheet eject transport of the printing sheet. The sheet transport control unit 68 performs feed control with respect to the sheet feed unit based on the printing sheet number data, the printing sheet direction data, and the printing sheet size data, which are included in the print setting data, and the feed instruction from the image control unit 66.

The sheet transport control unit 68, in cooperation with the ink discharge control unit 67, controls the sheet transport unit 30 to transport the printing sheet so that the image forming can be appropriately performed onto the printing sheet. The sheet transport control unit 68 controls the sheet transport unit 30 to feed and transport the printing sheet to the middle transport unit 40, and rotates respective pulleys and belt platen 41 through a motor 45. Further, the sheet transport control unit 68 controls the middle transport unit 40 to transport the printing sheet, on which an image is formed by the ink jet head 20, to a discharge unit.

The sheet transport control unit 68 has a remainder sheet number count function that reduces the number of printing sheets that is indicated by the printing sheet number data by 1 whenever the printing sheet is discharged after image forming thereon. When the remainder number of printing sheets becomes 0, the sheet transport control unit 68 sends data that indicates the print end to the image control unit 66.

The ink discharge control unit 67 acquires the number of pulses from an encoder installed on each pulley. The ink discharge control unit 67 drives the respective head blocks 200 to discharge ink to positions, in which the image forming is to be performed, on the printing sheet through drivers of the ink jet heads 20 based on the acquired number of pulses and the ink discharge amounts of the respective pixel positions on the print target area of the image data.

Print Method

Figure 14:
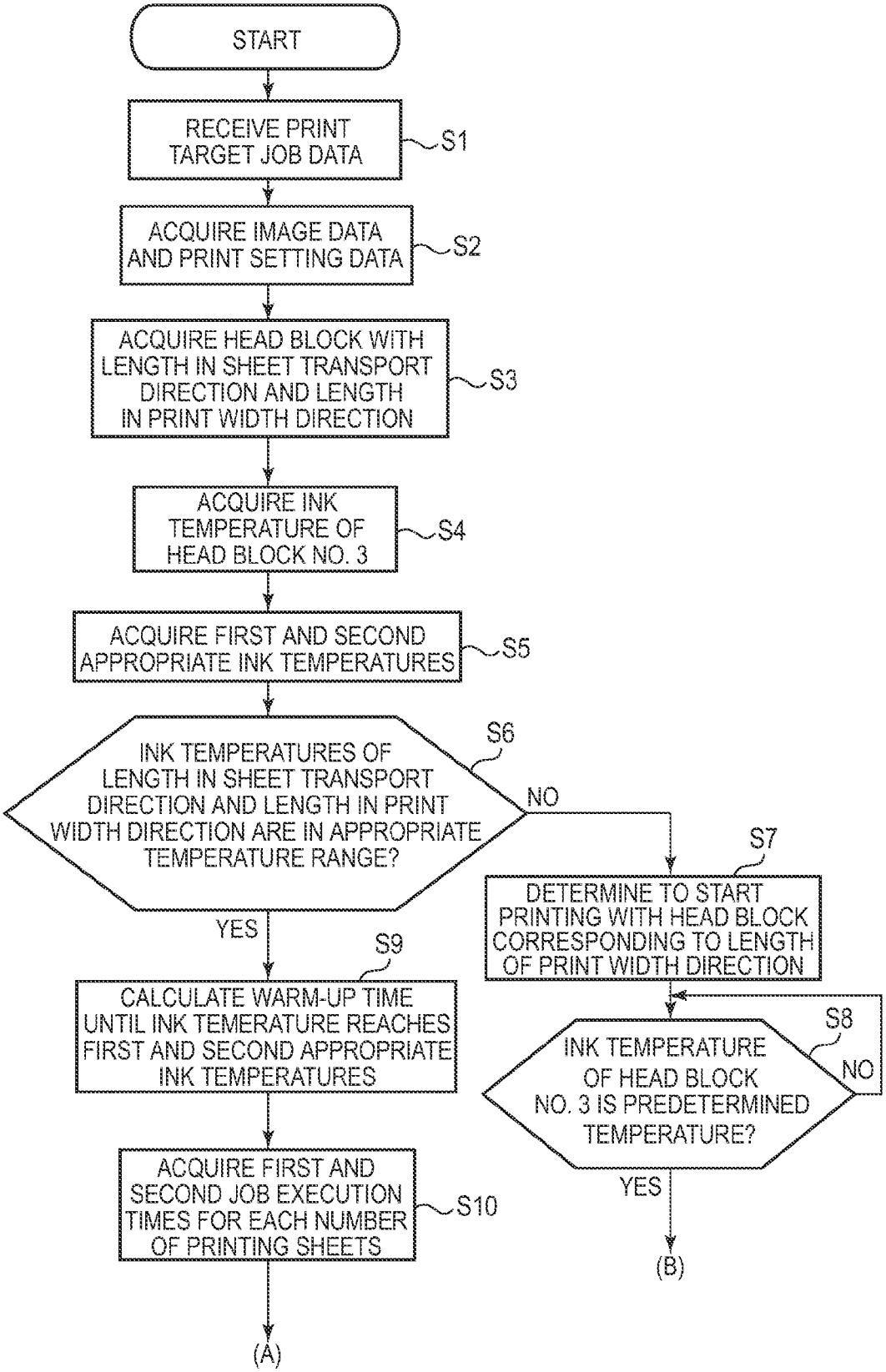
FIG. 14 is a flowchart illustrating a print method according to the first embodiment.
Figure 15:
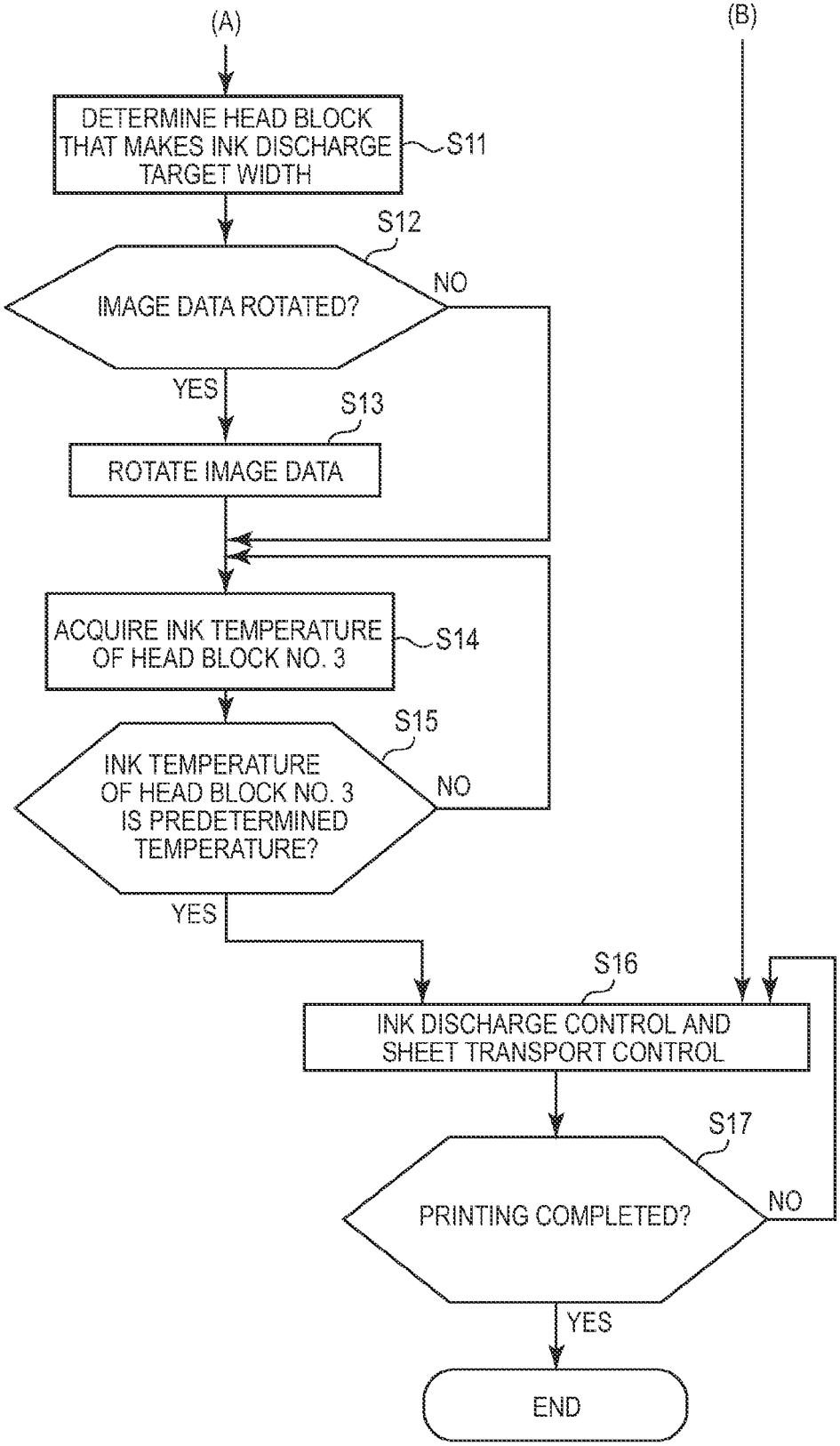
FIG. 15 is a flowchart illustrating a print method according to the first embodiment.

A print method using the ink jet printer 2 having the configuration as described above will be described referring to FIGS. 14 to 17. FIGS. 14 and 15 are flowcharts illustrating a control process for ink jet printing by the control unit 60. As shown in FIG. 14, if the print target job data is generated by a terminal unit 1 and the print target job data is sent to the ink jet printer 2, the communication unit 22 receives the print target job data and sends the received print target job data to the control unit 60 (S1).

The image control unit 66 acquires the image data and the print setting data from the print target job data (S2), and acquires the printing sheet number data, the printing sheet direction data, and the printing sheet size data, which are included in the print setting data. The image control unit 66 acquires data that specifies the head block 200 that corresponds to one of the length of the long side of the predetermined area and the length of the short side of the predetermined area of the image data, which is parallel to the sheet transport direction (for example, the length of the long side, and hereinafter referred to as the "length of the sheet transport direction") and the head block 200 that corresponds to the length that is parallel to the print width direction (for example, the length of the short side, and hereinafter referred to as the "length of the print width direction") with reference to the discharge target width data (S3).

The appropriate temperature range determination unit 63 acquires the current ink temperature from the ink temperature detection unit 24 that is installed in the head block No. 3 (S4). The appropriate temperature range determination unit 63 acquires the ink temperature (first appropriate ink temperature) of the head block No. 3 in the case where the ink temperature of the head block 200 that corresponds to the length of the sheet transport direction is within the appropriate temperature range and the ink temperature (second appropriate ink temperature) of the head block No. 3 in the case where the ink temperature of the head block 200 that corresponds to the length of the print width direction is within the appropriate temperature range (S5).

The appropriate temperature range determination unit 63 determines whether or not the ink temperature of the head block 200 that corresponds to the length of the sheet transport direction and the ink temperature of the head block 200 that corresponds to the length of the print width direction are both in the appropriate temperature range from the current ink temperature acquired in S4, the first appropriate ink temperature, and the second appropriate ink temperature (S6). In the process of S6, the detailed explanation of acquiring the ink discharge target width and the corresponding head block from the current ink temperature acquired in S4 will be described later with reference to FIG. 17.

If it is determined that both of the ink temperatures are not in the appropriate temperature range in S6, the process proceeds to S7. The current ink temperature, the ink temperature of the head block 200 that corresponds to the length of the sheet transport direction, the ink temperature of the head block 200 that corresponds to the length of the print width direction, the first appropriate ink temperature, and the second appropriate ink temperature are sent to the warm-up time calculation unit 64, and the process of S9 is performed. If it is determined that either one of the ink temperatures is in the appropriate temperature range, the process proceeds to S7.

The appropriate temperature range determination unit 63 determines that the printing starts with the head block 200 that corresponds to the length of the print width direction (S7). The appropriate temperature range determination unit 63 determines whether or not the current ink temperature of the head block No. 3 reaches the ink temperature of the head block No. 3 to make the head block 200 at which the print start is determined as the ink discharge target width (S8). If it is determined "NO" in S8, the process proceeds to S8, while if it is determined "YES" in S8, the process proceeds to S16.

The warm-up time calculation unit 64 calculates the warm-up time in which the head block NO. 3 becomes the first appropriate ink temperature from the current ink temperature and the warm-up time in which the head block No. 3 becomes the second appropriate ink temperature from the current ink temperature with reference to the warm-up time table (S9).

The image control unit 66 acquires the first job execution time until the execution of the print target job data, which has started using the head block 200 that corresponds to the length of the sheet transport direction, is completed and the second job execution time until the execution of the print target job data, which has started using the head block 200 that corresponds to the length of the print width direction, is completed for every number of printing sheets that is used in the print target job data (S10).

The image control unit 66 generates a job execution time graph from the warm-up time calculated by the warm-up time calculation unit 64, the first execution time, and the second execution time. The image control unit 66 compares the time that is obtained by summing the warm-up time and the job execution time in the case where the head block 200 corresponding to the length of the sheet transport direction makes the ink discharge target width with the time that is obtained by summing the warm-up time and the job execution time in the case where the head block 200 corresponding to the length of the print width direction makes the ink discharge target width, based on the number of printing sheets that the printing sheet number data indicates from the job execution time graph, and determines that the head block 200 that corresponds to the width of the one of shorter time makes the ink discharge target width (S11).

The image control unit 66 determines whether or not to rotate the image data in the orthogonal direction in order to make the head block 200 which corresponds to the width of the one of shorter time that is determined in S11 as the ink discharge target width (S12).

If it is determined "YES" in S12, the image control unit 66 rotates the image data (S13). On the other hand, if it is determined "NO" in S12, the image control unit 66 does not rotate the image data, but proceeds to the process of S14. If the process of S12 or S13 is ended, such a fact is sent to the appropriate temperature range determination unit 63.

The appropriate temperature range determination unit 63 acquires the current ink temperature from the ink temperature detection unit 24 that is installed in the head block No. 3 (S14). The appropriate temperature range determination unit 63 determines whether or not the current ink temperature reaches the ink temperature (the first appropriate ink temperature or the second appropriate ink temperature) of the head block No. 3 to make the head block 200 that corresponds to the width of the one of shorter time in S11 as the ink discharge target width (S15). If it is determined "NO" in S15, the process proceeds to S14. If it is determined "YES" in S15, the process proceeds to S16.

The ink discharge control unit 67 controls the ink discharge of the head block 200 that corresponds to the width of the one of shorter time in S11 or the width determined in S7 based on the dot data after the image processing that is stored in the dot data storage unit, and the sheet transport control unit 68 controls the sheet transport based on the print setting data (S16).

The image control unit 66 determines whether or not the printing of the number of printing sheets included in the print setting data is ended based on the printing sheet number counting function (S17), and if it is determined "YES" in S17, the process is ended. On the other hand, if it is determined "NO" in S17, the process proceeds to S16.

Figure 16:
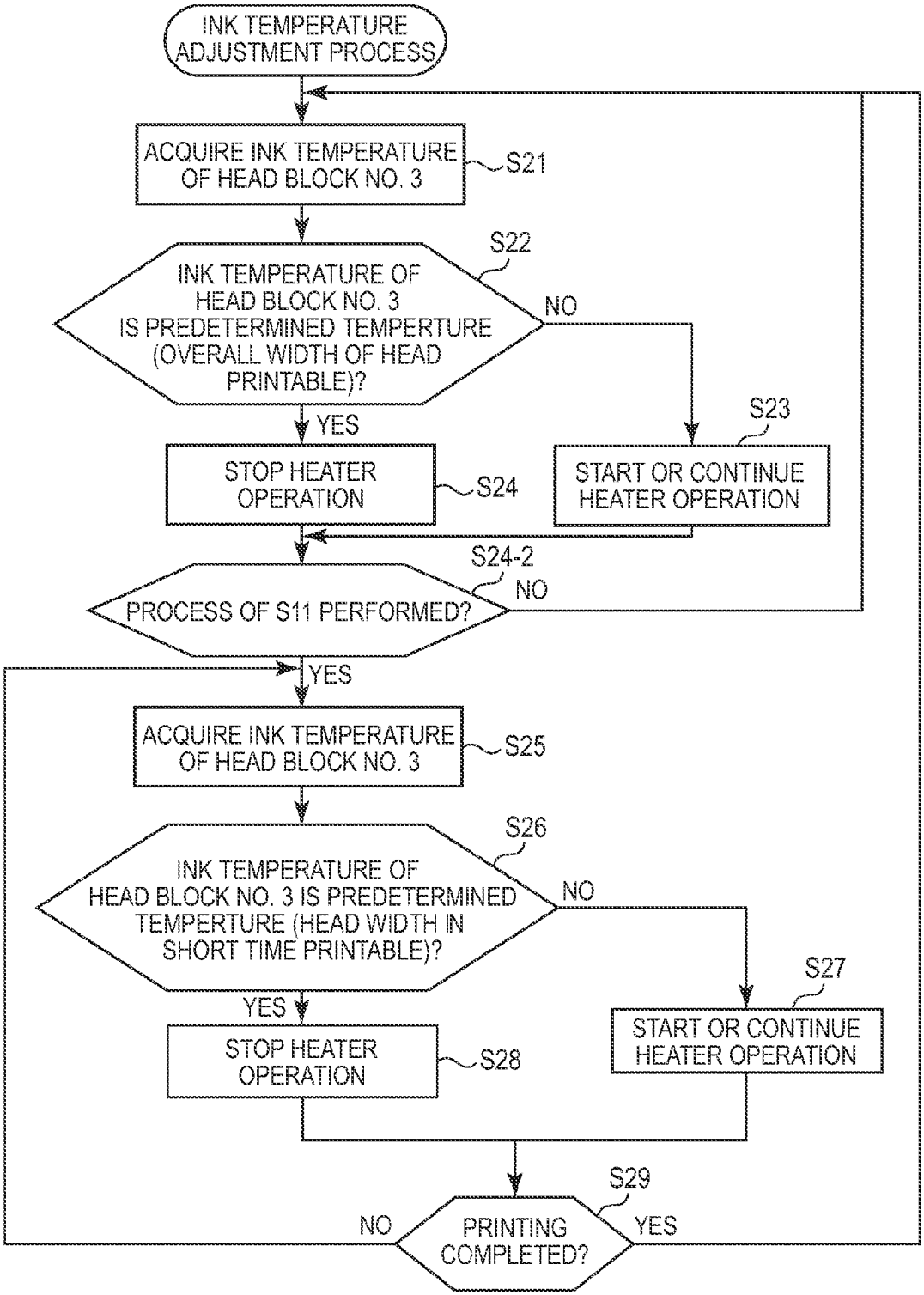
FIG. 16 is a flowchart illustrating an ink temperature adjustment process according to the first embodiment.

FIG. 16 is a flowchart illustrating an ink temperature adjustment process when the power of the ink jet printer 2 is turned on. The process illustrated in FIG. 16 is performed in a predetermined period interval.

The ink temperature adjustment control unit 61 acquires the current ink temperature from the ink temperature detection unit 24 that is installed in the head block No. 3 (S21). The ink temperature adjustment control unit 61 determines whether or not the ink temperature acquired in S21 reaches the ink temperature of the head block No. 3 to make all the head blocks 200 (Nos. 1 to 6) as the ink discharge target width (S22).

If it is determined "NO" in S22, the heater operation of the ink temperature adjustment unit 52 is started or continued (S23), and the process proceeds to S24-2. If it is determined "YES" in S22, the heater operation of the ink temperature adjustment unit 52 is stopped (S24), and the process proceeds to S24-2. The ink temperature adjustment control unit 61 determines whether or not the process of S11 has been performed (S24-2), and if it is determined "YES" in S24-2, the process proceeds to S25. If it is determined "NO" in S24-2, the process proceeds to S21.

The ink temperature adjustment control unit 61 acquires the current ink temperature from the ink temperature detection unit 24 that is installed in the head block No. 3 (S25). The ink temperature adjustment control unit 61 determines whether or not the current ink temperature reaches the ink temperature of the head block No. 3 to make the head block 200 that corresponds to the width of the one of shorter time in S11 as the ink discharge target width (S26).

If it is determined "NO" in S26, the heater operation of the ink temperature adjustment unit 52 is started or continued (S27), and the process proceeds to S29. If it is determined "YES" in S26, the heater operation of the ink temperature adjustment unit 52 is stopped (S28), and the process proceeds to S29.

The ink temperature adjustment control unit 61 determines whether or not the printing is ended in S17 (S29), and if it is determined "NO" in S29, the process proceeds to S25. If it is determined "YES" in S29, the process proceeds to S21.

Figure 17:
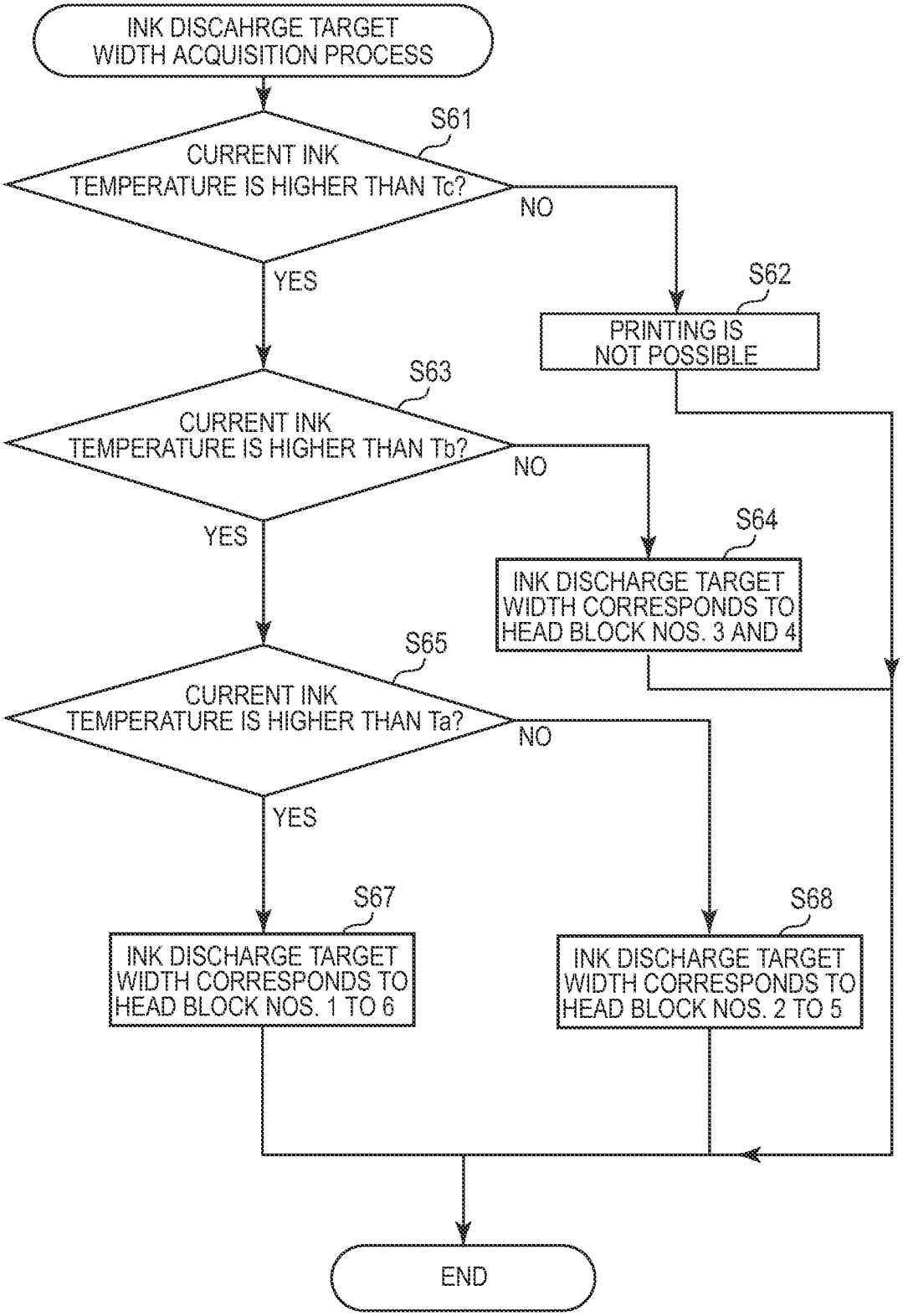
FIG. 17 is a flowchart illustrating a printable width acquisition process according to the first embodiment.

FIG. 17 is a flowchart illustrating the details of acquiring the ink discharge target width and the corresponding head block from the current ink temperature acquired in S4. The appropriate temperature range determination unit 63 determines whether or not the current ink temperature acquired in S4 is higher than the ink temperature Tc (ink temperature of the head block No. 3 in the case where the ink temperatures of the head block Nos. 3 and 4 reach the appropriate temperature range (S61).

If it is determined "YES" in S61, the process proceeds to S63, and if it is determined "NO" in S61, it is determined that printing is not possible (S62). The appropriate temperature range determination unit 63 determines whether or not the current ink temperature acquired in S4 is higher than the ink temperature Tb (ink temperature of the head block No. 3 in the case where the ink temperatures of the head block Nos. 2 to 5 reach the appropriate temperature range (S63).

If it is determined "YES" in S63, the process proceeds to S65, and if it is determined "NO" in S63, it is determined that the ink discharge target width corresponds to the head blocks Nos. 3 and 4 (S64). The appropriate temperature range determination unit 63 determines whether or not the current ink temperature acquired in S4 is higher than the ink temperature Ta (ink temperature of the head block No. 3 in the case where the ink temperatures of the head blocks Nos. 1 to 6 reach the appropriate temperature range (S65).

If it is determined "YES" in S65, the process proceeds to S67, and if it is determined "NO" in S65, it is determined that the ink discharge target width corresponds to the head blocks Nos. 2 to 5 (S66). In S67, the appropriate temperature range determination unit 63 determines that the ink discharge target width corresponds to the head blocks Nos. 1 to 6.

From the results of the determination as above, the appropriate temperature range determination unit 63 can determine the head block 200 of the ink discharge target width with respect to the current ink temperature in S4. From the results, the appropriate temperature range determination unit 63 can determine whether or not the ink temperature of the head block 200 that corresponds to the length of the sheet transport direction and the ink temperature of the head block 200 that corresponds to the length of the print width direction are in the appropriate temperature range from the current ink temperature of the head block No. 3.

Second Embodiment

In this embodiment, the same reference numerals are given to the same configurations and functions as the first embodiment, and the explanation thereof will be omitted or simplified.

Configuration of Ink Jet Printer

If the number of printing sheets is equal to or larger than a predetermined number L, the image control unit 66 according to this embodiment controls the rotation of the image data in which the direction of the short side of the predetermined area becomes the print width direction so that the image forming becomes possible through the ink jet head 20 in the first ink discharge target width, and if it is determined by the appropriate temperature range determination unit 63 that the ink temperature of the second ink discharge target width is in the appropriate temperature range, the image control unit 66 controls the rotation of the image data in which the direction of the long side of the predetermined area becomes the print width direction so that the image forming becomes possible through the ink jet head 20 in the second ink discharge target width.

As described above according to the first embodiment, the image control unit 66 acquires the first warm-up time, the second warm-up time, the number of printing sheets included in the print setting data, and job execution time for each number of printing sheets. In this embodiment, the image control unit 66 performs the following process.

In the first embodiment as described above, as shown in FIG. 11, if the size of the printing sheet targeted for the print of the image data is A4 size, the time point when the warm-up time and the job execution time elapse from the acquisition of the print target job data, in consideration of the number of printing sheets L as a border, becomes earlier, but the case where the head blocks Nos. 2 to 5, which can print the length (200 mm) of the short side of the predetermined area, make the ink discharge target width is changed to the case where the head blocks Nos. 1 to 6, which can print the length (290 mm) of the long side of the predetermined area, make the ink discharge target width.

In this embodiment, if the number of printing sheets included in the print setting data is larger than L, the image control unit 66 first determines that the head blocks 200 (Nos. 2 to 5) that can print the length (200 mm) of the short side of the predetermine area make the ink discharge target width. In this case, the rotating process or the like by the image control unit 66 is the same as that as described above according to the first embodiment.

The image control unit 66 monitors the ink temperature of the head block No. 3 until the ink temperature of the head blocks Nos. 2 to 5 that can print the length of the short side of the predetermined area reaches the ink temperature Tb of the head block No. 3 that is in the appropriate temperature range. Then, the image control unit 66 instructs the ink temperature adjustment unit 52 to perform the warm-up operation.

The image control unit 66 performs the re-storage process, if necessary, and if the data indicating that the ink temperature reaches the ink temperature Tb of the head block No. 3 is acquired, the image control unit 66 instructs the ink discharge control unit 67 to perform printing of the printing sheet and instructs the sheet transport control unit 68 to start the paper-feeding by the sheet feed unit.

If it is determined by the appropriate temperature range determination unit 63 that the ink temperature of the head blocks Nos. 1 to 6 that can print the length of the long side of the predetermined area reaches the appropriate temperature range, the image control unit 66 determines that the head blocks Nos. 1 to 6 which can print the length of the long side of the predetermined area make the ink discharge target width.

The image control unit 66 monitors the ink temperature of the head block No. 3 until the ink temperature of the head blocks Nos. 1 to 6 that can print the length of the long side of the predetermined area reaches the ink temperature (for example, Ta) of the head block No. 3 that is in the appropriate temperature range.

The image control unit 66 performs the re-storage process, if necessary, and if the data indicating that the ink temperature reaches the ink temperature Ta of the head block No. 3 is acquired, the image control unit 66 instructs the ink discharge control unit 67 to perform printing of the printing sheet and instructs the sheet transport control unit 68 to start the paper-feeding by the sheet feed unit.

Print Method

Figure 18:
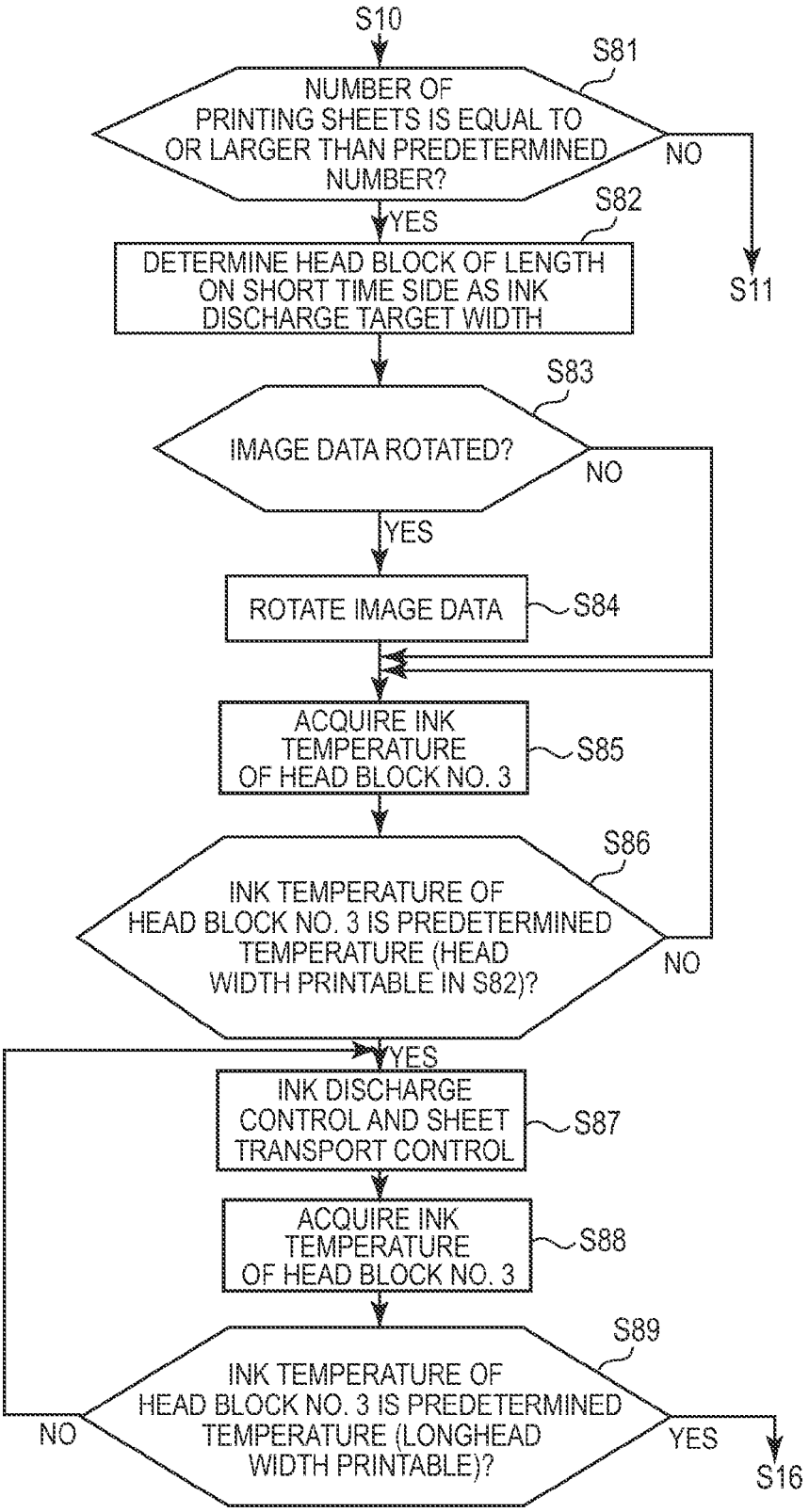
FIG. 18 is a flowchart illustrating a print method according to a second embodiment.

A print method using the ink jet printer having the configuration as described above will be described referring to FIG. 18. The same reference numerals are given to the same or similar processes as shown in FIGS. 14 and 15, and the explanation thereof will be omitted or simplified. As shown in FIG. 18, after performing the processes from S1 to S10, the image control unit 66 determines whether or not the number of printing sheets indicated by the printing sheet number data is equal to or larger than a predetermined number (the above-described number of printing sheets L) (S81). If it is determined "NO" in the process of S81, the processes after S11 as shown in FIG. 15 are performed.

On the other hand, if it is determined "YES" in the process of S81, it is determined that the head block 200 that corresponds to the length of the print width direction or the length of the sheet transport direction on the side where the warm-up time calculated by the warm-up time calculation unit 64 is shorter makes the ink discharge target width (S82).

The image control unit 66 determines whether or not to rotate the image data so that the head block 200 determined in S82 makes the ink discharge target width (S83). If it is determined "YES" in S83, the image control unit 66 rotates the image data (S84). On the other hand, if it is determined "NO" in S83, the image control unit 66 does not rotate the image data, but the process proceeds to S85. The appropriate temperature range determination unit 63 acquires the current ink temperature from the ink temperature detection unit 24 that is installed in the head block No. 3 (S85).

The appropriate temperature range determination unit 63 determines whether or not the current ink temperature reaches the ink temperature (the first appropriate ink temperature or the second appropriate ink temperature) of the head block No. 3 to make the head block 200 determined in S82 as the ink discharge target width (S86). If it is determined "NO" in S86, the process proceeds to S85. If it is determined "YES" in S86, the ink discharge control unit 67 controls the ink discharge and the sheet transport control unit 68 controls the sheet transport (S87).

The appropriate temperature range determination unit 63 acquires the current ink temperature from the ink temperature detection unit 24 installed in the head block No. 3 (S88). The appropriate temperature range determination unit 63 determines whether or not the current ink temperature reaches the ink temperature of the head block No. 3 to make the head block 200 that corresponds to the length of the print width direction or the length of the sheet transport direction on the side where the calculated warm-up time is longer as the ink discharge target width, from the current ink temperature acquired in S88, the first appropriate ink temperature, and the second appropriate ink temperature (S89).

If it is determined "NO" in the process of S89, the process proceeds to S87. If it is determined "YES" in the process of S89, the processes after S16 are performed.

Modified Example of Respective Embodiments

The configurations and functions according to the above-described embodiments are merely exemplary, and the following modifications are possible.

(1) If both the first warm-up time and the second warm-up time calculated by the warm-up calculation unit 64 are shorter than the warm-up time in the case where the overall width of the ink jet head (head blocks Nos. 1 to 6) makes the ink discharge target width, the printing may start using the head block in which the ink discharge is possible after either one warm-up time is ended.

That is, if the warm-up time in the case where the long side of the predetermined area makes the ink discharge target width is shorter than the warm-up time in the case where the overall width of the ink jet head makes the ink discharge target width, the long side of the predetermined area may make the ink discharge target width.

(2) Regardless of the number of printing sheets included in the print setting data, the printing may start using the head block where the ink discharge is possible after the shorter warm-up time of the first warm-up time and the second warm-up time is ended. Through this, the situation that the execution of the print target job data is unable to start until the ink temperature of the overall ink discharge target width of the ink jet head reaches the appropriate temperature range as in the related art is avoided, and thus the first print can be hastened. Further, if the number of printing sheets is equal to or smaller than the predetermined number, it is possible to hasten the completion of the execution of the print job data.

(3) In the above-described embodiment, the appropriate temperature range determination unit 63 determines whether or not the ink temperature in the ink jet head 20 is in the appropriate temperature range in the first ink discharge target width and the second ink discharge target width when the communication unit 22 receives the print target job data.

However, it is also possible to determine whether or not the ink temperature in the ink jet head 20 is in the appropriate temperature range in either one ink discharge target width.

(4) In the above-described embodiment, the image data for forming the image in the predetermined rectangular area of the similar figure in the rectangular printing sheet is printed on the printing sheet. However, the present invention is not limited thereto. Even in the case where the image data for forming the image in the predetermined rectangular area in the printing sheet having a different shape is printed on the printing paper, the application is possible in the same manner. In this case, however, it becomes a condition that one side of the predetermined rectangular area is parallel to the sheet transport direction.

(5) According to the image data according to the above-described embodiment, the image information is included in the predetermined rectangular area. However, the present invention is not limited thereto. For example, the image control unit 66 may set the rectangular area so as to include an area in which the image density level is equal to or higher than a predetermined value (for example, in the case of binary data, the value of "1") if the image data that is included in the print target job data is acquired.

(6) In the above-described embodiment (processing shown in FIG. 17), the head block 200 that corresponds to the ink discharge target width (printable width) is determined by the ink temperature of the head block No. 3. However, the head block 200 may be determined by the ink temperature of other head blocks or by a specified position in the ink jet head 20. Further, the determination may be made as follows.

The appropriate temperature range determination unit 63 maintains the table that indicates the ink discharge target width (0 mm) in the case where there is not the head block 200 that reaches the appropriate temperature range, the ink discharge target width (110 mm) in the case where the head blocks 200 that reach the appropriate temperature range are Nos. 3 and 4, the ink discharge target width (220 mm) in the case where the head blocks 200 that reach the appropriate temperature range are Nos. 2 to 5, and the ink discharge target width (330 mm) in the case where the head blocks 200 that reach the appropriate temperature range are Nos. 1 to 6. Further, the appropriate temperature range determination unit 63 may determine the head block 200 that corresponds to the ink discharge target width with reference to the ink temperature detected by the ink temperature detection unit 24 installed in each head block 200 and the table.

Further, in the case where 6 head blocks 200 of the ink jet head 20 are arranged in symmetric relations about the transport center position in the position of Y axis, the head blocks 200 may be determined by the ink temperature of the unilateral head blocks 200 (Nos. 1 to 4) in the Y-axis direction with respect to the transport center position.

The appropriate temperature range determination unit 63 maintains the table that indicates the ink discharge target width (0 mm) in the case where there is not the head block 200 that reaches the appropriate temperature range, the ink discharge target width (330 mm) in the case where the head block 200 that reaches the appropriate temperature range is No. 1, the ink discharge target width (220 mm) in the case where the head block 200 that reaches the appropriate temperature range is No. 2, the ink discharge target width (110 mm) in the case where the head block 200 that reaches the appropriate temperature range is No. 3, and the ink discharge target width (0 mm) in the case where the head block 200 (No. 4) does not reach the appropriate temperature range.

Further, the appropriate temperature range determination unit 63 may determine the head block 200 that corresponds to the ink discharge target width with reference to the ink temperatures detected by the ink temperature detection units 24 installed in the respective head blocks 200 (Nos. 1 to 4) and the table. Further, the appropriate temperature range determination unit 63 may also determine the head block 200 that corresponds to the printable width by the number of head blocks 200, of which the ink temperatures reach the appropriate temperature range, among the respective head blocks 200 of the ink jet head 20.

The appropriate temperature range determination unit 63 maintains the table that indicates the ink discharge target width (0 mm) in the case where the number of head blocks 200 that reach the appropriate temperature range is 0 or 1, the ink discharge target width (110 mm) in the case where the number of head blocks 200 that reach the appropriate temperature range is 2 or 3, the ink discharge target width (220 mm) in the case where the number of head blocks 200 that reach the appropriate temperature range is 4 or 5, and the ink discharge target width (330 mm) in the case where the number of head blocks 200 that reach the appropriate temperature range is 6. Further, the appropriate temperature range determination unit 63 may determine the head block 200 that corresponds to the ink discharge target width with reference to the number of head blocks, which reach the appropriate temperature range that is determined depending on the ink temperature detected by the ink temperature detection unit installed in each head block 200, and the table.

(7) In the above-described embodiment, the ink jet head 20 has 6 head blocks 200. However, the number of head blocks may differ. Further, in the above-described embodiment, when the power supply is turned on, all the head blocks 200 are warmed up and are maintained in the appropriate temperature range. However, the present invention is not limited thereto. If a sleep state where the printing operation is not performed exceeds a predetermined time even though the power supply is turned on, in addition to the power supply off, the heater operation may be turned off. Further, when the print target job data is received in the ink jet printer 2, the sleep state may be released and the warm-up operation may start.

(8) Even except for the case where the print target job data is generated by the terminal unit 1, the application of the present invention is possible. For example, the present invention is also applicable in the case where the print target job data that includes an image read by a scanner is sent to the ink jet printer 2 or in the case where the print target job data that includes an image sent by a facsimile transmission is sent to the ink jet printer 2.

(9) The ink temperature adjustment unit 52 is installed in the ink circulation mechanism 50. However, the installation of the ink temperature adjustment unit 52 is not limited thereto. If it is possible to adjust the ink temperature of the ink jet head 20, the ink temperature adjustment unit 52 may be installed in other places (for example, in the neighborhood of the head block 200). Further, the ink temperature adjustment unit 52 may be installed depending on the ink colors.

(10) In the above-described embodiment, if it is assumed that the ink temperature of the head block No. 3 in the case where the ink temperatures of the head blocks Nos. 1 to 6 that correspond to the length of the length of the sheet transport direction reach the appropriate temperature range is Ta, and the ink temperature of the head block No. 3 in the case where the ink temperatures of the head blocks Nos. 2 to 5 that correspond to the length of the print width direction reach the appropriate temperature is Tb, the present invention is applicable in the same manner in the case where the ink temperature of the head block No. 3 has already reached Tb, but has not reached Ta yet when the print target job data is received.

In this case, since the ink temperature of the head block 200 that corresponds to the length of the print width direction has already reached the appropriate temperature range, it is not calculated for the warm-up time. For example, in the case of returning from the sleep state to the reception of the print target job data in the case where there is a big difference in ink temperature between the head block 200 of the center portion in the neighborhood of the transport center position in the Y-axis direction and the head block 200 in the end portion, it may be considered that the ink temperature of the head block 200 that corresponds to one of the sheet transport direction and the sheet width direction (head block 200 that corresponds to the length of the short side of the predetermined area of the image data) has already reached the appropriate temperature range, but the ink temperature of the head block 200 that corresponds to the other (head block 200 that corresponds to the length of the long side of the predetermined area of the image data) is out of the appropriate temperature range.

Figure 19:
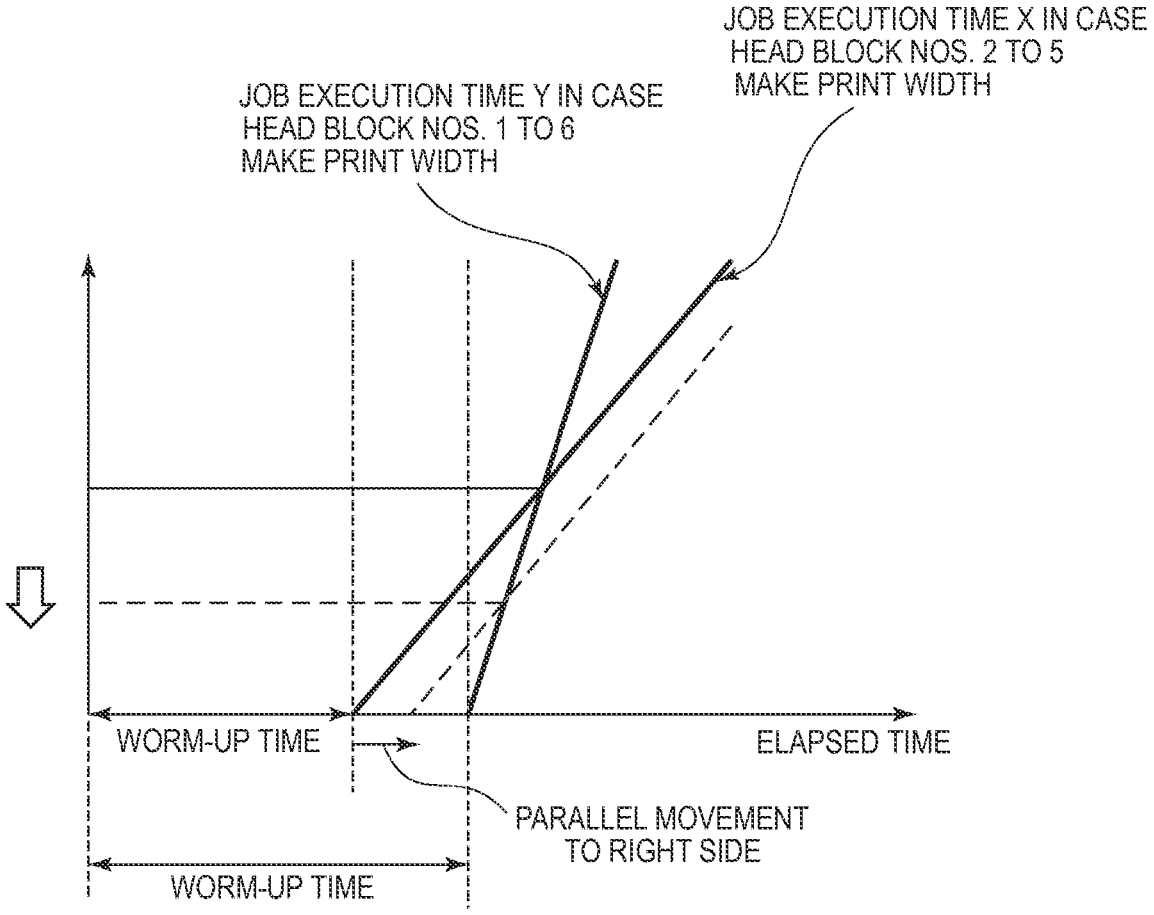
FIG. 19 is a diagram illustrating a job execution time graph according to a modified example.

For example, explanation will be made using FIG. 19 that is the same execution time graph as FIG. 11. In the case where the ink jet printer 2 acquires the print target job data in the timing between the warm-up time on the short side and the warm-up time on the long side, the straight line X that indicates the completion timing of the job execution for each number of printing sheets after the warm-up time on the short side is moved in parallel to the right side so that the straight line X indicates the completion timing of the job execution for each number of printing sheets after the acquisition of the print target job data.

The cross point of the straight line X (dotted portion) moved in parallel and the straight line Y that indicates the completion timing of the job execution for each number of printing sheets may be considered as a new number of printing sheets L. Thereafter, the same process as the above-described embodiment may be performed.

(11) In the above-described embodiment, the ink jet head 20 includes the plurality of head blocks 200 that are arranged in a zigzag form. However, the shape of the ink jet head is not limited thereto, and one long ink jet head 20 may be installed for each color.

(12) In the above-described embodiment, in the above-described execution time graph, it is determined whether the length of the sheet transport direction or the length of the print width direction makes the ink discharge target width based on the number of printing sheets L. However, the present invention is not limited thereto. For example, it is also possible to notify a manager of the ink jet printer 2 of the number of printing sheets L and to make the number of printing sheets in the neighborhood of the number of printing sheets L except for the number of printing sheets L as a new number of printing sheets L.

If the number of printing sheets included in the printing sheet number data is the number of printing sheets in the neighborhood of the number of printing sheets L, the side where the width of the head block 200 is longer may be the ink discharge target width even if the number of printing sheets is equal to or smaller than the number of printing sheets L, and the side where the width of the head block 200 is shorter may be the ink discharge target width even if the number of printing sheets is equal to or larger than the number of printing sheets L. In the case of the number of printing sheets in the neighborhood, the timing of the elapse of the time that is obtained by adding the warm-up time and the job execution time does not change that much, and thus it becomes possible to consider the user's circumstances.

(13) In the above-described embodiment, it is described that the ink path is the ink circulation type print system. However, the ink path is not limited thereto, and the ink path may be the print system that is not of the ink circulation type.

(14) In the above-described embodiment, the ink temperature operations of the respective head blocks 200 of the four ink jet heads 20 are the same. However, the present invention is not limited thereto. For example, the warm-up time calculation unit 64 calculates the first warm-up time and the second warm-up time as described above even if the ink temperature operations of the respective head blocks 200 of the ink jet heads 20 for the respective colors somewhat differ. Further, the job execution time measurement unit 65 may make the timing when the job execution time is added after the latest first warm-up time and the timing when the job execution time is added after the latest second warm-up time as the job execution completion timing.

While the preferred embodiments of the present invention have been described using specified terms, such description is for illustrative purposes, and it is to be understood that changes and variations may be made without departing from the spirit or scope of the following claims.

What is claimed is:

1. An ink jet printer performing execution of a print job using a line type ink jet head which acquires the print job that includes image data for forming an image in a rectangular area on a recording medium and performs image forming through an ink discharge in a print width direction that is orthogonal to a transport direction of the recording medium, the ink jet printer comprising:

a temperature adjustment unit that performs a warm-up operation to make an ink temperature in the line type ink jet head reach an appropriate temperature range;

an appropriate temperature range determination unit that determines whether or not the ink temperature in the line type ink jet head is in the appropriate temperature range in a first ink discharge target width where an ink discharge is permitted in a length of a short side of the rectangular area in an acquisition timing of the print job;

a warm-up time calculation unit that calculates a first warm-up time by using the temperature adjustment unit until the ink temperature in the line type ink jet head corresponding to the first ink discharge target width, which is determined to be out of the appropriate temperature range by the appropriate temperature range determination unit, reaches the appropriate temperature range; and an image control unit that controls rotation of the image data so that a direction of the short side of the rectangular area becomes the print width direction if the first warm-up time calculated by the warm-up time calculation unit is shorter than a warm-up time until the ink temperature of an overall ink discharge target width of the line type ink jet head reaches the appropriate temperature range;

wherein the appropriate temperature range determination unit determines whether or not the ink temperature in the line type ink jet head is in the appropriate temperature range in a second ink discharge target width where the ink discharge is possible in a length of a long side of the rectangular area in the acquisition timing of the print job, the warm-up time calculation unit calculates a second warm-up time by using the temperature adjustment unit until the ink temperature in the line type ink jet head corresponding to the second ink discharge target width, which is determined to be out of the appropriate temperature range by the appropriate temperature range determination unit, reaches the appropriate temperature range;

a job execution time measurement unit is provided, the job execution time measurement unit measures a first execution time until the execution of the print job, which has started using the line type ink jet head in the first ink discharge target width, is completed and a second execution time until the execution of the print job, which has started using the line type ink jet head in the second ink discharge target width, is completed for every number of recording media used for the execution of the print job; and the image control unit controls the rotation of the image data so that the direction of the short side of the rectangular area or the direction of the long side of the rectangular area becomes the print width direction depending on the number of recording media used for the execution of the print job based on a result of a comparison of a sum of the first execution time and the first warm-up time with a sum of the second execution time and the second warm-up time.

2. The ink jet printer according to claim 1, wherein if the number of recording media is equal to or smaller than a predetermined number, the image control unit controls the rotation of the image data so that the direction of the short side of the rectangular area becomes the print width direction, and if the number of recording media is larger than the predetermined number, the image control unit controls the rotation of the image data so that the direction of the long side of the rectangular area becomes the print width direction.

3. The ink jet printer according to claim 1, wherein if the number of recording media is equal to or larger than a predetermined number, the image control unit controls the rotation of the image data so that the direction of the short side of the rectangular area becomes the print width direction, and if it is determined that the ink temperature in the line type ink jet head corresponding to the second ink discharge target width is in the appropriate temperature range by the appropriate temperature range determination unit, the image control unit controls the rotation of the image data so that the direction of the long side of the rectangular area becomes the print width direction.

* * * * *